US009140030B2

(12) United States Patent
Jin

(10) Patent No.: US 9,140,030 B2
(45) Date of Patent: Sep. 22, 2015

(54) FOLDABLE TENT

(71) Applicant: Ki Ho Jin, Xiamen (CN)

(72) Inventor: Ki Ho Jin, Xiamen (CN)

( * ) Notice: Subject to any disclaimer, the term of this patent is extended or adjusted under 35 U.S.C. 154(b) by 117 days.

(21) Appl. No.: 13/842,589

(22) Filed: Mar. 15, 2013

(65) Prior Publication Data

US 2014/0076372 A1 Mar. 20, 2014

(30) Foreign Application Priority Data

Sep. 19, 2012 (CN) ..... 2012 2 0478761 U
Feb. 5, 2013 (CN) ..... 2013 2 0066279 U
Feb. 5, 2013 (CN) ..... 2013 3 0036600

(51) Int. Cl.
*E04H 15/48* (2006.01)
*E04H 15/46* (2006.01)
*E04H 15/52* (2006.01)
*E04H 15/42* (2006.01)

(52) U.S. Cl.
CPC ..... *E04H 15/48* (2013.01); *E04H 15/42* (2013.01); *E04H 15/46* (2013.01); *E04H 15/52* (2013.01)

(58) Field of Classification Search
CPC ..... E04H 15/48; E04H 15/18
USPC ..... 135/97, 121, 147, 156
See application file for complete search history.

(56) References Cited

U.S. PATENT DOCUMENTS 3,766,932 A * 10/1973 Sidis et al. ..... 135/147
3,838,703 A * 10/1974 Zeigler ..... 135/136
4,078,572 A * 3/1978 Moss ..... 135/97
4,285,355 A * 8/1981 Lundblade ..... 135/147
4,998,552 A 3/1991 Niksic et al.
5,197,504 A * 3/1993 Howe ..... 135/127
5,573,028 A * 11/1996 van der Stigohel ..... 135/147
5,732,726 A * 3/1998 Lee ..... 135/156
5,771,651 A * 6/1998 Shiina ..... 52/641
D535,350 S * 1/2007 Ju ..... D21/834

(Continued)

FOREIGN PATENT DOCUMENTS

CN 201474367 U 5/2010
EP 1310616 A2 * 5/2003
GB 2300011 A * 10/1996
GB 2321656 A 8/1998
GB 2482745 A 2/2012

OTHER PUBLICATIONS

Canadian Intellectual Property Office, Patent Application No. 2,816,689, Examiner's Report dated Jun. 4, 2014.

(Continued)

*Primary Examiner* — David R Dunn
*Assistant Examiner* — Danielle Jackson
(74) *Attorney, Agent, or Firm* — John H. Choi

(57) ABSTRACT

A foldable tent includes a frame coupled to a canopy such that the frame and canopy are collectively collapsible from an open configuration to a folded configuration. The frame includes a plurality of spaced apart hubs positioned at an upper portion of the frame, at least one upper roof pole pivotally coupled with two adjacent hubs, a plurality of lower roof poles pivotally coupled to a corresponding hub and extending radially outward from each respective hub and away from the upper roof pole, and a plurality of collapsible side poles pivotally coupled to a corresponding lower roof pole. A canopy fixedly slidably coupled to the frame such that the canopy is positioned within a radially inner space surrounded by the frame when the tent is in the open configuration and collectively collapsed and folded into a compact folded configuration.

19 Claims, 18 Drawing Sheets

(56) References Cited

U.S. PATENT DOCUMENTS

| | | | | |
|---|---|---|---|---|
| 7,766,023 | B2 * | 8/2010 | Scherer | 135/126 |
| 8,448,656 | B2 * | 5/2013 | Choi | 135/135 |
| 2010/0229907 | A1 | 9/2010 | Panigot | |

OTHER PUBLICATIONS

Ki Ho Jin, Response to Jun. 4, 2014 Examiner's Report in Canada Pat. App. No. 2,816,689, dated Dec. 3, 2014.

* cited by examiner

FOLDABLE TENT

CROSS REFERENCES TO RELATED APPLICATIONS

This application claims priority to China Patent Application Nos. 201220478761.4 (filed Sep. 19, 2012); 201320066279.4 (filed Feb. 5, 2013); and 201330036600.X (filed Feb. 5, 2013), which are incorporated by reference in their entireties.

BACKGROUND OF THE INVENTION

The present invention relates to a tent and more particularly to a foldable or collapsible tent.

For novice campers and camping families, among others, foldable tents are a popular alternative to conventional assemble-to-use tents. These tents are commonly referred to as "instant tents," "one-touch tents" or "pop-up tents." Foldable tents are typically sold with a frame assembly and tent fabric permanently attached to each other, i.e., preassembled. Erecting and collapsing the tent is easy and less time consuming than conventional assemble-to-use tents because the frame assembly and tent fabric are collectively opened and folded. The frame assembly usually includes a single central hub and a plurality of poles pivotally attached to the hub to provide a stable tent structure. These types of instant tents are particularly advantageous because a minimal number of poles, typically four, are required and thus erecting and collapsing the instant tent is quite simple. Although convenient for the user, there are several disadvantages for instant tents in the prior art.

For example, a large amount of stress is exerted on the frame assembly due to the tension from the tent fabric. These stresses are often transferred to and concentrated on the single central hub where the poles are interconnected, especially when a wind force is exerted on the tent. Thus, there is risk of damage or even failure of the central hub.

Also, the size of instant tents in the prior art today are limited and could typically accommodate only up to nine people because stability of the structure is compromised with longer poles required for larger instant tents. Therefore, even though there is great interest for bigger tents (often including separate rooms), this cannot be achieved with an instant tent today. Instead, larger tents that could accommodate more than nine people are of the conventional type which requires the user to separately assemble the poles and then attach the poles to the tent fabric for set up, and detach the poles from tent fabric and disassemble the poles to store and transport.

Another disadvantage of instant tents of the prior art is that head room is limited. The central portion of the instant tent where the central hub is located serves as the apex of the tent. Even though cabin instant tents attempt to solve this problem, the poles are positioned downwardly and the ceiling height decreases from the central portion of the tent. Thus, head room is still limited at radially outer portions of the tent.

As another example, instant tents in the prior art are limited in shape. They are either dome shape or a single rectangular cabin. The use of a single central hub also limits the overall configuration of the instant tent because the overall length of the tent is restricted by the length of the poles which can securely extend from the central hub. Therefore, a tent with a more elongated configuration or other configurations cannot be achieved.

Instant tents today also pose problems with folding the tent into a relatively short and compact state. The folded length of the tent as well as the volume of the tent is dictated by the sections of the poles which are connected to the central hub and because those pole sections are usually elongated to increase the overall volume of the tent in the open configuration, the instant tent is relatively long when folded.

OBJECTS AND SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention is intended to overcome at least the above-described disadvantages. The objects and advantages of the present invention, more specifically, are to provide: an instant tent where the stresses exerted on the frame are more evenly distributed so that the risk of damage or failure to the frame assembly is reduced; a safe instant tent with larger volume so that more people could be accommodated; an instant tent with increased head room throughout the tent; an instant tent having configurations other than dome or traditional cabin configurations; and an instant tent capable of folding into a more compact state.

For achieving the above-mentioned objects, the present invention provides a foldable tent comprising a frame coupled to a canopy where the frame and canopy are collectively collapsible from an open configuration to a folded configuration. The frame comprises a plurality of hubs, each hub spaced apart and positioned at an upper portion of the frame, at least one upper roof pole having opposing ends, the opposing ends of each of the at least one upper roof poles being pivotally coupled with two adjacent hubs, a plurality of lower roof poles having first and second ends, the first ends of each lower roof pole pivotally coupled to a corresponding hub, each lower roof pole extending radially outward from each respective hub and away from the upper roof pole, and a plurality of side poles having first and second ends, the first ends of each side pole pivotally coupled to a corresponding lower roof pole second end forming an angle between said poles when in the open configuration, the second ends of each side pole engagable with a ground surface, each side pole being collapsible at a portion between the first and second ends of the side pole. A canopy is fixedly slidably coupled to the frame such that the canopy is positioned within a radially inner space surrounded by the frame when the tent is in the open configuration.

The present invention also provides a foldable tent comprising a frame assembly coupled to a tent fabric, the frame assembly and tent fabric collectively collapsible from an open configuration to a folded configuration. The frame assembly comprises a first hub spaced apart from a second hub; a central roof pole having opposing ends, the central roof pole positioned at a central portion of the frame assembly, each respective end of the roof pole pivotally coupled with the first and second hubs; and a plurality of leg poles each having an inner end and an outer end, each leg pole being collapsible in between the inner and outer ends, the inner ends of each leg pole pivotally coupled to a corresponding hub, wherein in the open configuration each leg pole extends radially outward with respect to the central roof pole and the outer ends of each leg pole engages a ground surface; wherein the tent fabric is fixedly slidably coupled to the frame assembly such that the tent fabric is positioned within a radially inner space surrounded by the frame assembly when the tent is in the open configuration.

The present invention further provides a foldable tent comprising a frame coupled to a canopy, the frame and canopy collectively collapsible from an open configuration to a folded configuration. The frame comprises a central hub, a plurality of roof poles having an inner end and an outer end, each roof pole inner end pivotally coupled to the central hub and extending radially outward therefrom, a plurality of auxiliary hubs, each roof pole outer end pivotally coupled to a corresponding auxiliary hub, and a plurality of collapsible leg poles each having an inner end and an outer end, the inner ends of each leg pole pivotally coupled to each hub, the outer ends of each leg pole engaging a ground surface when the tent is in the open configuration; wherein the canopy is permanently slidably coupled to the frame such that the canopy is positioned within a radially inner space surrounded by the frame when the tent is in the open configuration.

BRIEF DESCRIPTION OF THE DRAWINGS

To better understand the present invention, a more particular description of the invention will be rendered by reference to the appended drawings.

Figure 1:
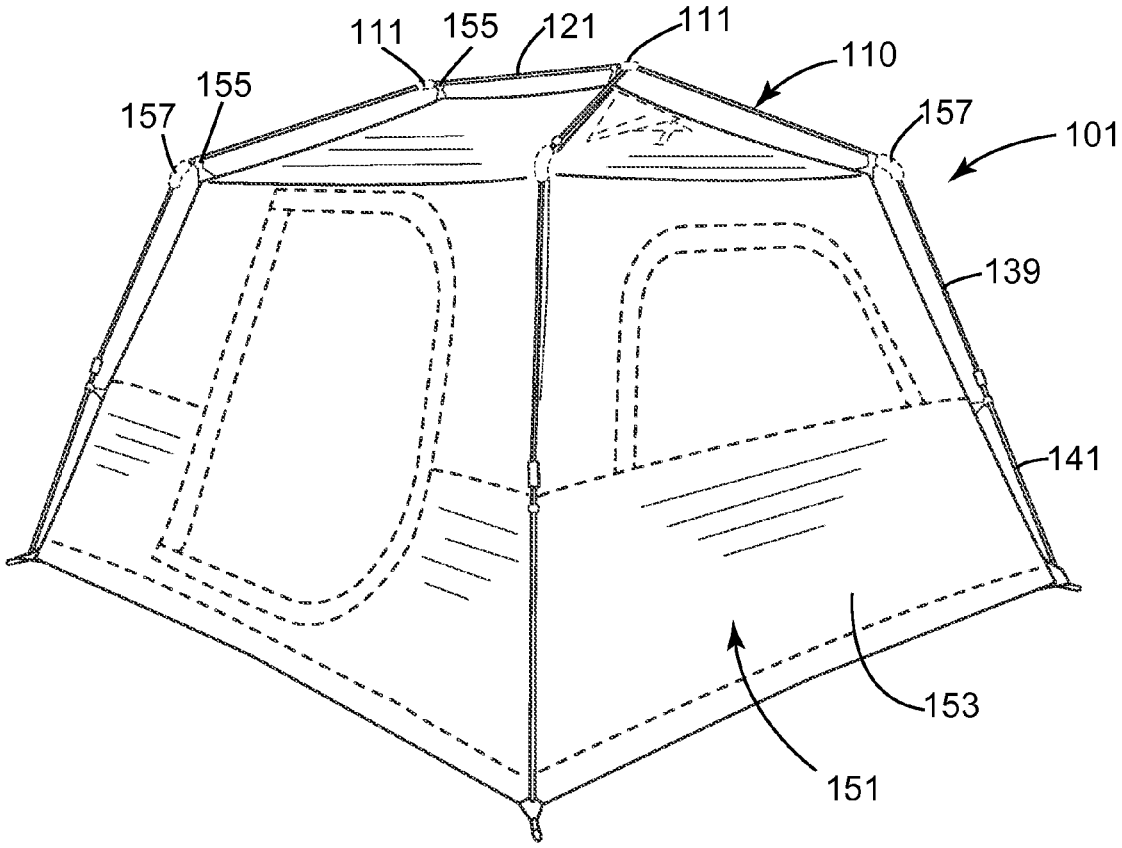
FIG. 1 is a perspective view of an embodiment of a foldable tent of the present invention in an open configuration.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE INVENTION

Certain terminology is used in the following description for convenience only and is not limiting. The article "a" is intended to include one or more items. Where only one item is intended, the term "one" or similar language is used. Additionally, to assist in the description of the present invention, words such as top, bottom, front, rear, right and left are used to describe the accompanying figures. The terminology includes the words above specifically mentioned, derivatives thereof, and words of similar import.

Figure 2:
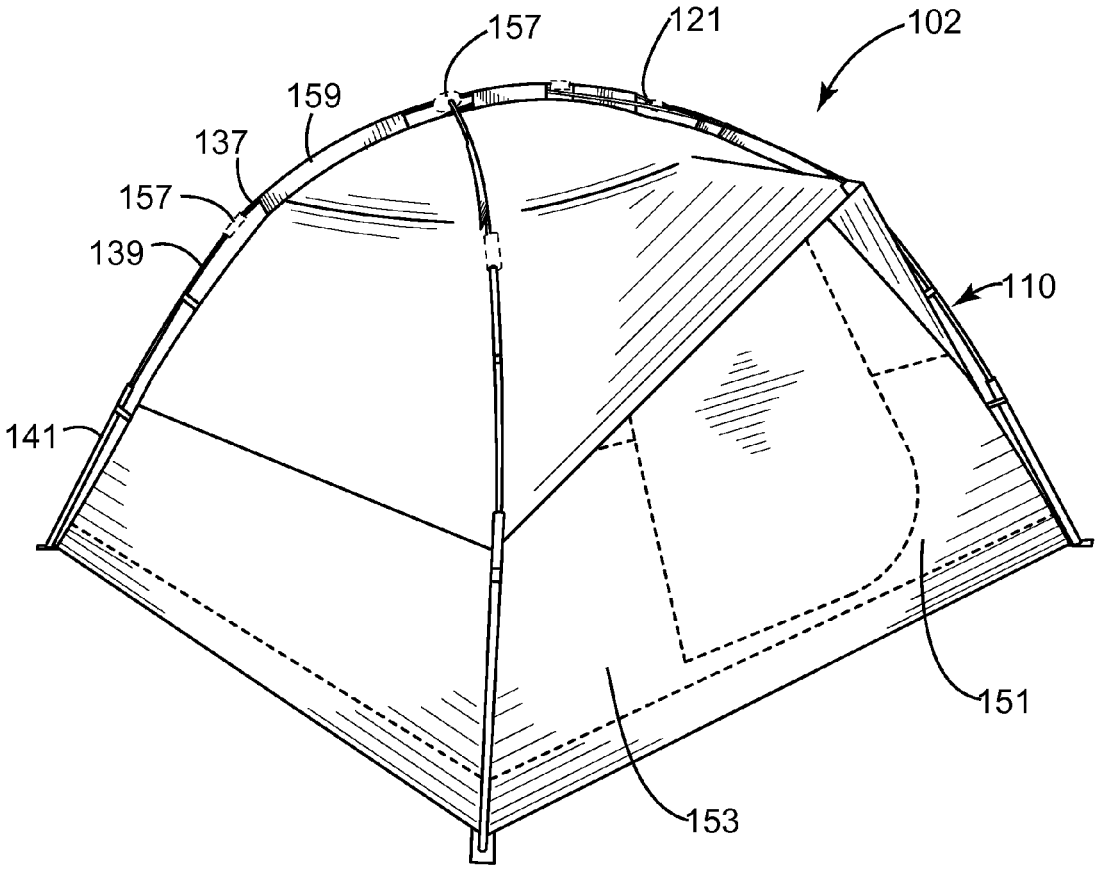
FIG. 2 is a perspective view of another embodiment of a foldable tent of the present invention in an open configuration.
Figure 3:
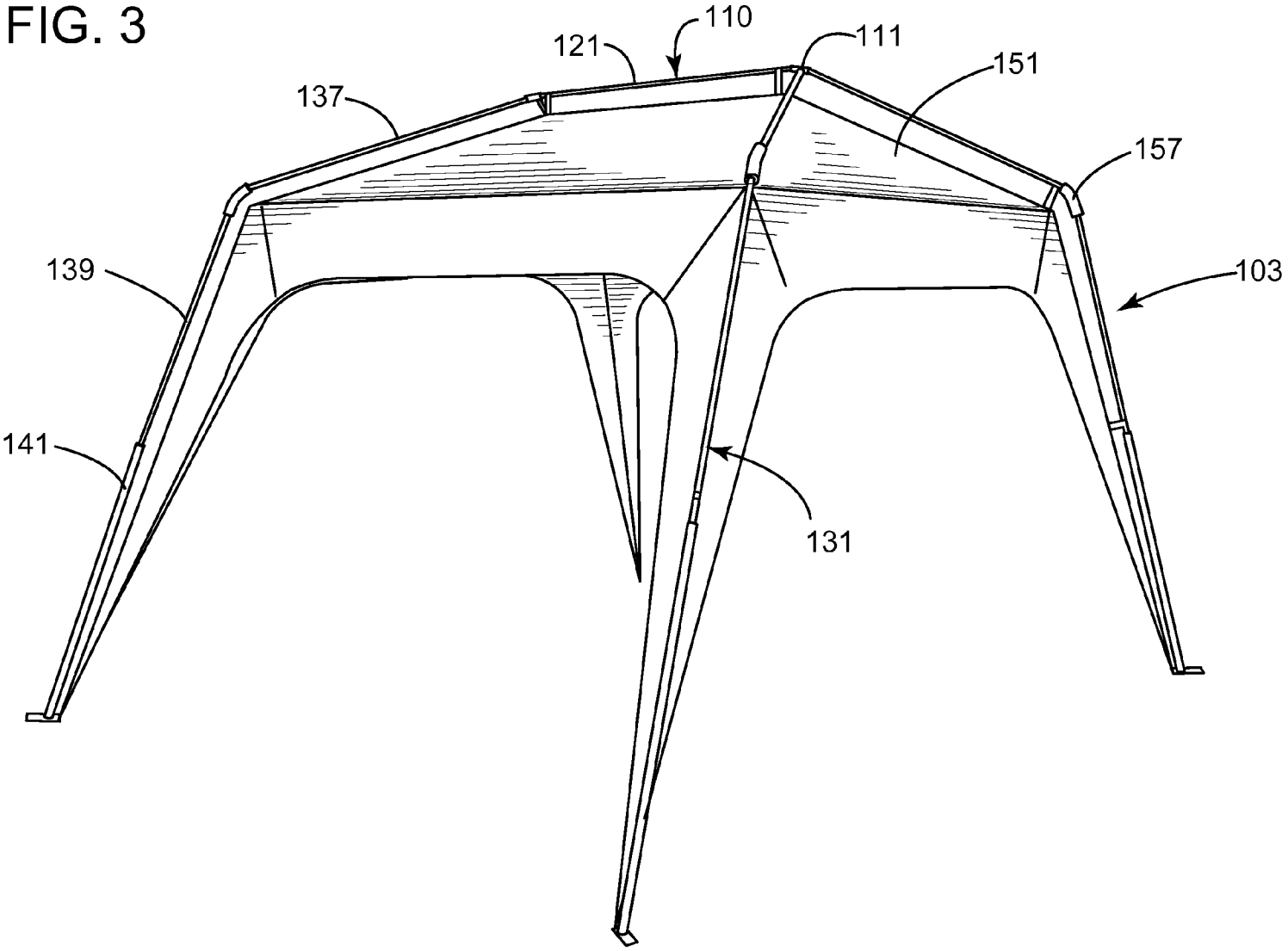
FIG. 3 is a perspective view of another embodiment of a foldable tent of the present invention in an open configuration.

Referring to FIGS. 1-3, three separate embodiments 101-103 of a foldable tent of the present invention are shown. Each of these embodiments include a frame assembly 110 as illustratively shown in FIGS. 4-7, which is foldable from an open configuration as shown in FIG. 4 to a folded configuration as shown in FIG. 7.

Figure 35:
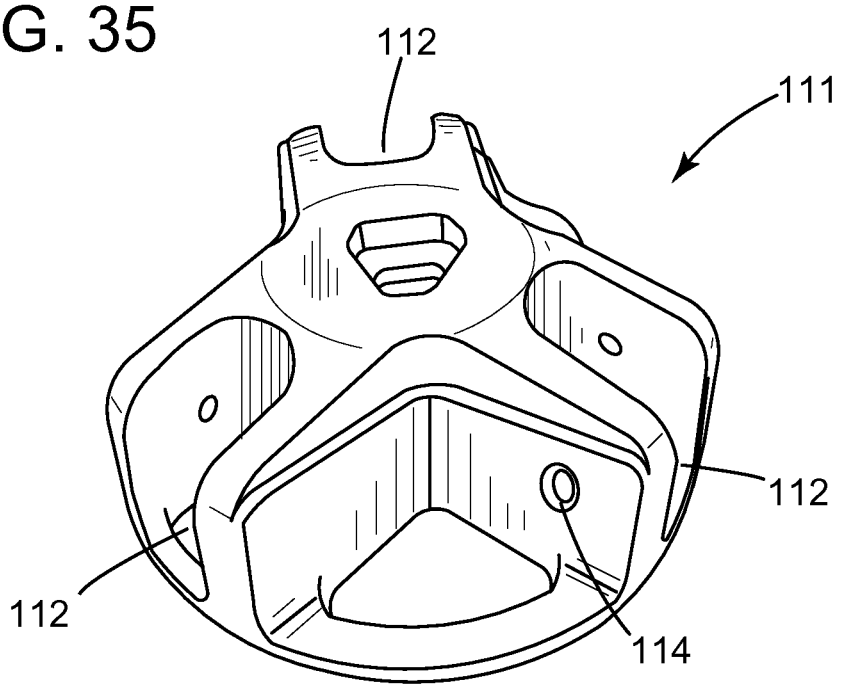
FIG. 35 is a perspective view of an embodiment of an instant tent hub of the present invention.
Figure 36:
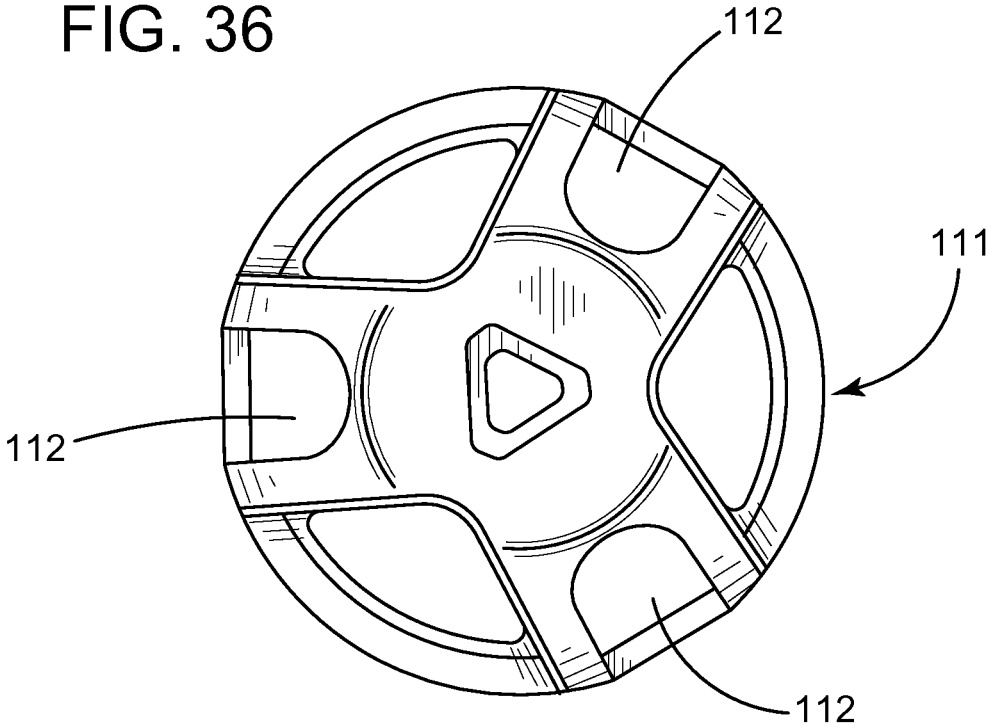
FIG. 36 is a plan view of the instant tent hub of FIG. 35.
Figure 37:
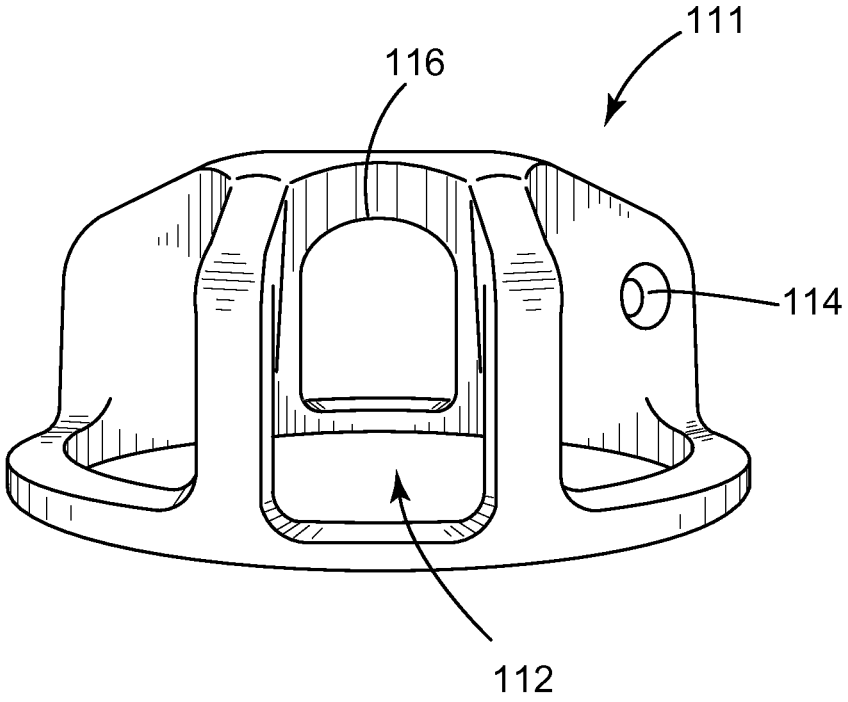
FIG. 37 is a side view of the instant tent hub of FIG. 35.

Referring to FIGS. 4-7, the frame assembly 110 generally includes a pair of spaced apart hubs 111 which are configured to receive poles for pivotal engagement. In this embodiment, as shown in FIGS. 35-37, each hub 111 includes three slots 112 for pivotally attaching each pole but additional slots could be included depending on the desired overall configuration of the tent. Each pole is attached to a corresponding slot 112 by a fastener such as a screw or pin which extends through opposing apertures (or partial apertures) 114 of each slot 112. In the closed configuration each pole is pivotable upwardly to a position substantially perpendicular to a top surface of the hub as illustrated in the drawings of the folded configuration of the frame assemblies, and in the open configuration each pole is pivotable downwardly to a position where the poles extend radially outwardly from the hub 111 as illustrated in the drawings of the open configuration of the frame assemblies. The angle at which each pole extends in the open configuration depends on the configuration of a top surface 116 of each slot and the position of the apertures 114. For example, a lower top surface 116 coupled with the apertures 114 positioned at a higher level would yield a horizontal or a more upwardly extending pole. Thus, the positions of the top surface 116 and apertures 114 could be adjusted to form a desired extending angle for each pole. Other instant tent hubs capable of having poles pivotable upward to the folded configuration, such as those described in U.S. patent application Ser. Nos. 12/658,473 (filed Feb. 4, 2010), Ser. No. 13/295,396 (filed Nov. 14, 2011) and Ser. No. 13/560,021 (filed Jul. 27, 2012), which are incorporated by reference, could be used herein without departing from the spirit and scope of the present invention.

Figure 4:
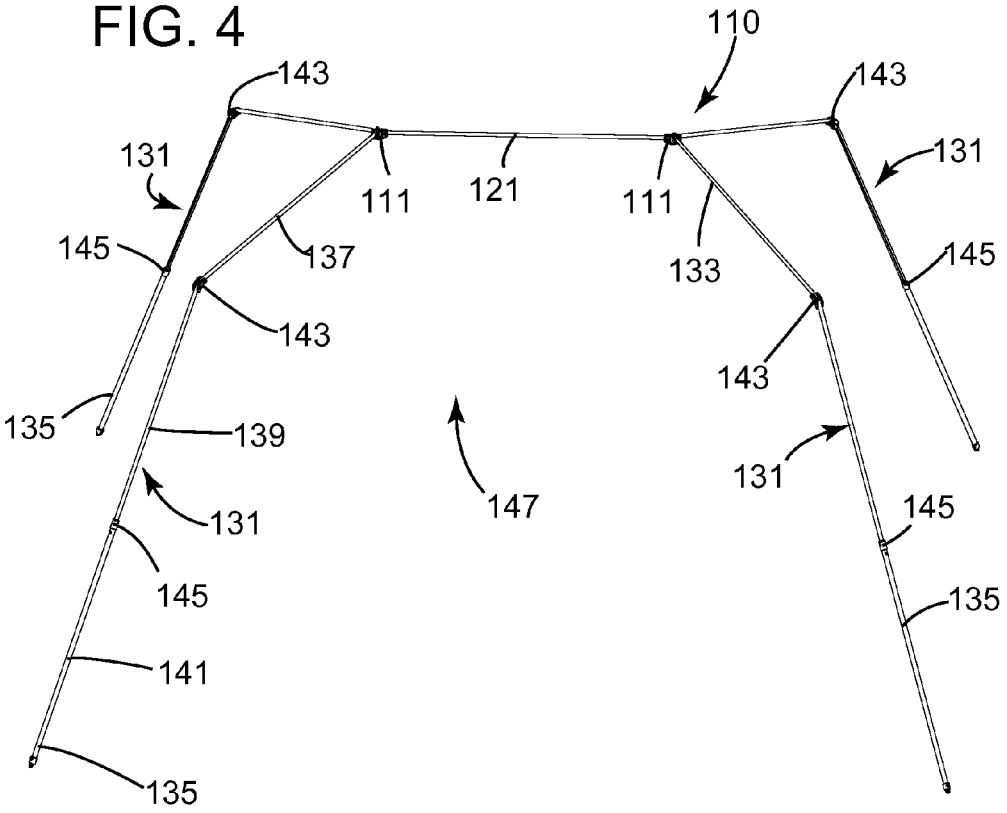
FIG. 4 is a front perspective view of an embodiment of a frame assembly of the present invention, shown in FIGS. 1-3, in an open configuration.

As shown in FIG. 4, one of the slots of each hub 112 faces the other such that a central roof pole 121 is pivotally attached to the opposing hubs 111. When in the open configuration, the central roof pole 121 is substantially horizontal to create more head room compared with conventional single hub foldable tents. In this embodiment, the central roof pole 121 is one continuous piece but it could also be constructed of multiple sections and telescopically connected if a more elongated tent configuration is desired.

Figure 5:
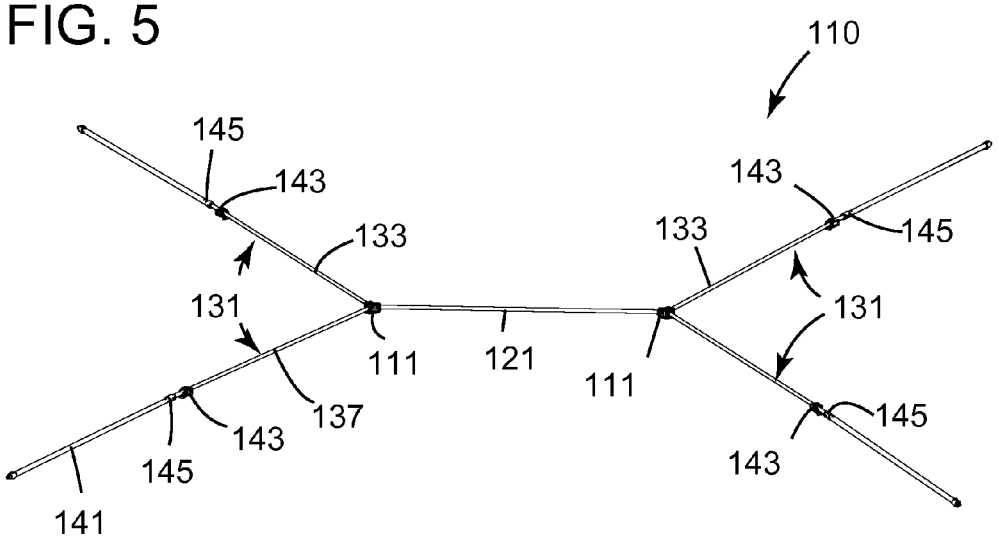
FIG. 5 is a front perspective view of the frame assembly of FIG. 4 in a first partially folded configuration.
Figure 6:
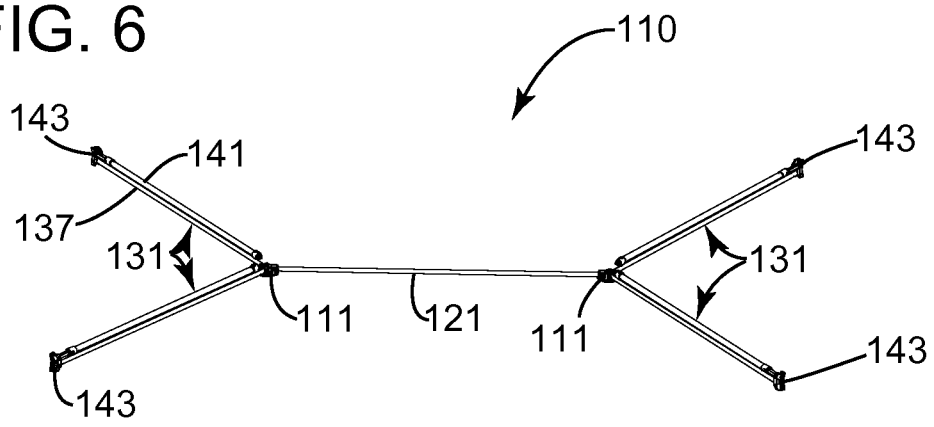
FIG. 6 is a front perspective view of the frame assembly of FIG. 4 in a second partially folded configuration.
Figure 7:
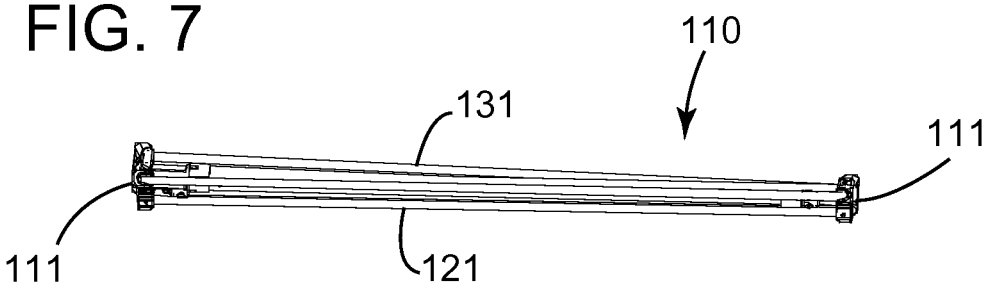
FIG. 7 is a front perspective view of the frame assembly of FIG. 4 in a fully folded configuration.

Still referring to FIGS. 4-7, the frame assembly 110 also includes a plurality of leg poles 131. Each leg pole 131 includes an inner end 133 and an outer end 135. In this embodiment, two leg poles 131 support each side of the frame assembly 110. The inner ends 133 are pivotally connected to each hub 111 as described above and the leg poles 131 are extended radially outward and away from the central roof pole 121. As mentioned above, additional leg poles could be attached to each hub 111 depending on the desired configuration of the tent. Each leg pole 131 includes an upper section (or lower roof pole) 137, a middle section 139 and a lower section 141. In this embodiment, the upper and middle sections 137, 139 are pivotally coupled together with a conventional pivoting joint 143 which includes opposing upwardly facing channels (not shown) positioned above a bottom surface (not shown) for receiving each of the adjoining sections 137, 139. The pivoting joint 143 is configured such that when the frame assembly 110 is in the open configuration as shown in FIG. 4, the upper and middle sections 137, 139 are fixed at an angle, and such that the upper and middle sections 137, 139 could be folded against each other when the frame assembly is in the partially folded and fully folded configurations as shown in FIGS. 6 and 7, respectively. In this embodiment, the diametrical dimensions of the middle and lower sections 139, 141 are such that the sections 139, 141 are telescopically coupled together and lockable in an extended position by conventional means, for example, with a locking mechanism 145 having a spring biased pin extending through aligned apertures of each section 139, 141. However, one of ordinary skill in the art will recognize that other methods and means could be used to couple and lock the middle and lower sections 139, 141 including but not limited to a lockable pole joint such that the sections 139, 141 are lockably extended, and unlocked and pivotably folded toward each other. Referring to FIG. 4, when the frame assembly 110 is in an open configuration, the frame assembly 110 surrounds a radially inner space 147.

In the present embodiment, each pole 121, 137, 139 and 141 is constructed of a rigid tubular steel having a diameter between 14.5 mm and 16 mm. However, in another embodiment, as shown in FIG. 2, the roof pole 121, upper poles 137 and middle poles 139 are constructed of a flexible fiberglass reinforced plastic (FRP), and the lower poles 141 are constructed of tubular steel such that each middle pole 139 is telescopically retractable within a corresponding lower pole 141. One of ordinary skill in the art will recognize that other materials such as other metals (e.g., aluminum), metal alloys, other polymers, composite materials or any combination thereof could be used, and different sizes of poles could be used depending on desired strength without departing from the spirit and scope of the invention.

Referring to FIGS. 1-3, several embodiments of a foldable tent of the present invention are shown for which the frame assembly 110 shown in FIGS. 4-7 is utilized. Each of the embodiments include a tent fabric or canopy 151 which is disposed within the radially inner space 147 formed by the frame assembly 110. In one embodiment 101, shown in FIG. 1, the tent fabric 151 has a roof, four side walls and a floor stitched together to form an enclosure 153. The foldable tent 101 is shown with features such as doors, windows and vents, however, the tent could be constructed with more or less features than shown. Also, each of the pivoting joints 143 are covered with a fabric casing 157 which protects the tent fabric 151 from damage when the tent is folded. The hubs 111 could be covered with fabric casings as well. The enclosure 153 is attached by slidable hooks 155 at various locations to the frame assembly 110. In the open configuration as shown in FIG. 1, the enclosure 153 is substantially taut and forms a substantially flat surfaces on the roof, side walls and floor. The frame assembly 110 is further stabilized by the tension created by the tent fabric 151. In this embodiment, the rigid frame assembly 110 coupled with the tent fabric 151 forms a cabin style tent.

Referring to FIG. 2, in another embodiment of a foldable tent of the present invention 102, the roof pole 121, upper poles 137 and middle poles 139 are flexible FRP and the lower poles 141 are tubular steel. The tent fabric 151 includes an inner tent or enclosure 153 and an integral rain fly which are slidably attached to the frame assembly 110 in the same manner as described above with respect to the cabin tent 101. In this embodiment, a top portion of the tent fabric includes sleeves 159 which attach to the frame assembly 110 but the sleeves could be replaced with hooks or other conventional attachment means such as hook-and-loop, hook-and-eye or the like. In addition, the hubs 111 are provided with a fabric casing 157 which protects the tent fabric 151 from damage during the folding process. In the open configuration as shown in FIG. 2, the tent fabric 151 is substantially taut and tension is applied to the frame assembly 110 which provides additional stability to the tent 102. A curvature is formed on the roof pole 121 as well as the leg poles 131 due to the utilization of flexible FRP and a dome style tent is provided.

Referring to FIG. 3, another embodiment of a foldable tent of the present invention 103 is shown. In this embodiment, the tent fabric 151 includes only a roof portion and portions along the leg poles 131 to form an open shelter. Similar to the tents 101, 102 described above, in the open configuration as shown in FIG. 3, the tent fabric 151 is substantially taut and exerts a radially inward tension to the frame assembly 110 to provide additional stability. One of ordinary skill in the art will recognize that other tent fabrics could be attached. For example, a tent fabric partially constructed of mesh having a roof and side walls without a floor could be utilized to form a screen house.

Referring to FIGS. 4-7, even though the tent fabric 151 is attached to the frame assembly 110 at all times, the operation of the embodiments of the foldable tent 101-103 shown in FIGS. 1-3 is shown without the tent fabric 151 for purposes of clarity. From the open configuration (FIG. 4), the middle and lower sections of the leg poles 139, 141 are retracted to form a first folded section (FIG. 5). Each of the first folded sections are pivoted outwardly about each corresponding pivoting joint 143 toward each corresponding upper section 137 to form a second folded section (FIG. 6). Each second folded section is then pivoted about each hub 111 such that the poles 121, 131 are pivoted upward with respect to each hub 111 into a fully folded configuration (FIG. 7). In the fully folded configuration, top portions of each hub 111 face each other and are in substantial parallel relationship. The tent 101-103 is unfolded to the open configuration in reverse order of the steps described above.

The structure of these embodiments of instant tents of the present invention 101-103 provides stability and could be constructed as an instant tent of all sizes that could accommodate anywhere from two people to more than nine.

Referring to FIGS. 8-25, several embodiments of another frame assembly for a foldable tent of the present invention are shown. In these embodiments, each frame assembly 202, 204, 206, 208, 210 includes a central hub 211 interconnected with auxiliary hubs 213 by roof poles 221 to provide support for oversized instant tents.

Figure 38:
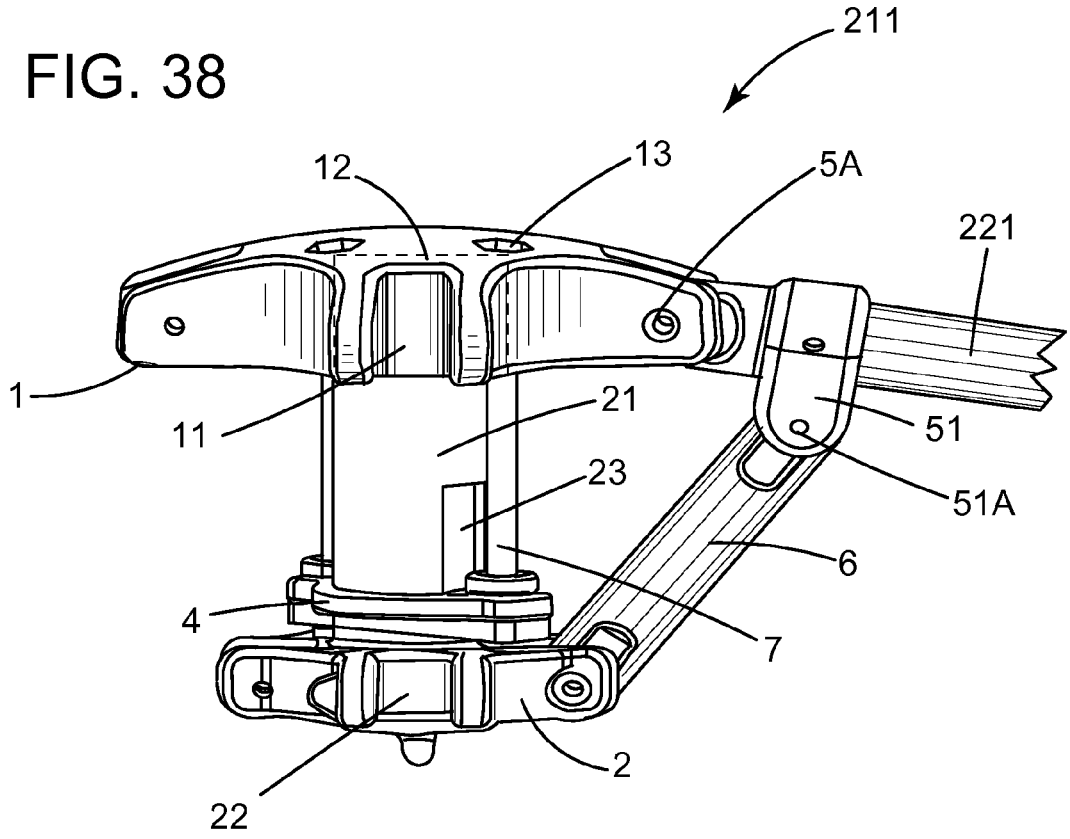
FIG. 38 is a partial perspective view of another embodiment of an instant tent hub of the present invention in an open configuration.
Figure 39:
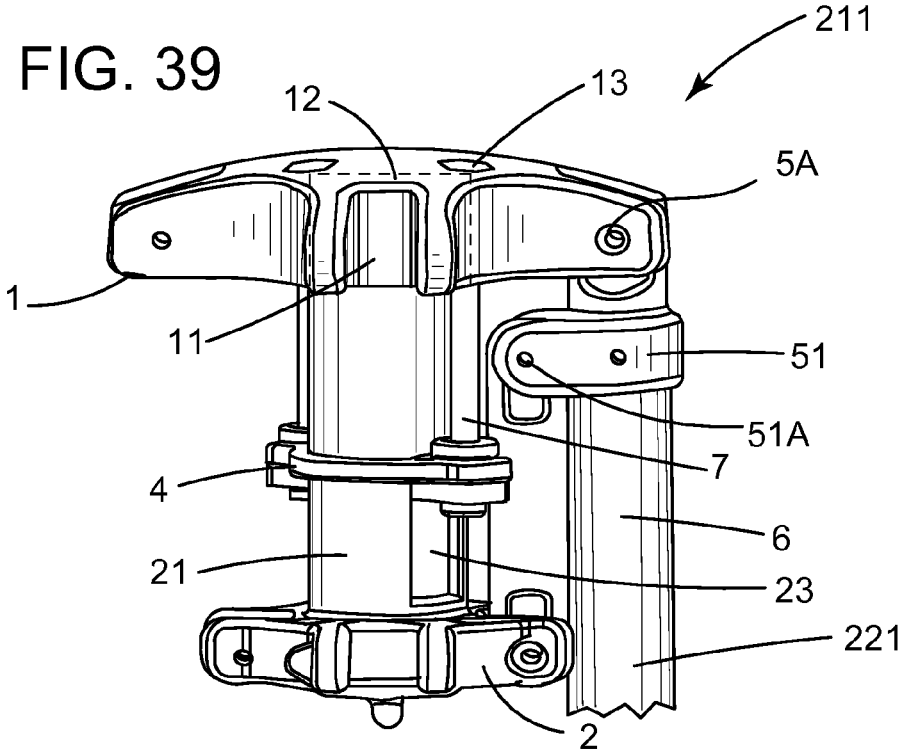
FIG. 39 is a partial perspective view of the instant tent hub of FIG. 38 in a folded configuration.

In one embodiment of a foldable tent 201, shown in FIGS. 8-11, the frame assembly 202 includes a central hub 211 positioned at a central portion of the tent 201. In this embodiment, the central hub 211 is the tent hub shown and described in U.S. Pat. No. 7,861,736, which is incorporated by reference in its entirety. Referring to FIGS. 38-39, an embodiment of the central hub 211 is shown. In general, the central hub 211 includes a biasing mechanism (not shown) which is placed into the inside of a shaft 21 of a base 2, and a sliding plate 4 positioned radially into cut-outs 23 of the base 2 and secured to a hub 1 with securing bolts 7 via vertical holes (not shown) of the base 2 and vertical holes 13 of the hub 1, so that the biasing mechanism is located in between the sliding plate 4 and a top inner surface of the shaft 21. The shaft 21 is movably fit into a central channel 12 of the hub 1. The roof poles 221 are pivoted respectively on pole slots 11 of the hub 1. Pivoting bases 51 are fixedly attached to the roof poles 221. Braces 6 are pivoted respectively on brace slots 22 of the base 2 on one end, and the other ends of the braces 6 are individually pivoted on corresponding pivoting bases 51 at lower engagement point 51A. In the open configuration as shown in FIG. 38 the roof poles 221 extend radially outward from the central hub 211. The central hub 211 could be configured such that the poles extending therefrom could extend to a substantially horizontal position. In the folded configuration as shown in FIG. 39 the roof poles 221 are pivoted downward to a substantially vertical position. The forces exerted on the roof poles 221 from the biasing member allow the frame assembly 202 to maintain its open and folded configurations without a locking mechanism. FIGS. 38 and 39 are shown with four slots 11, however, the hub 211 could be modified to include more or less slots depending on the number of poles pivotally attached thereto. One of ordinary skill in the art will recognize that other hubs could be used so long as the poles connected thereto are pivotable downward to a folded configuration.

Figure 9:
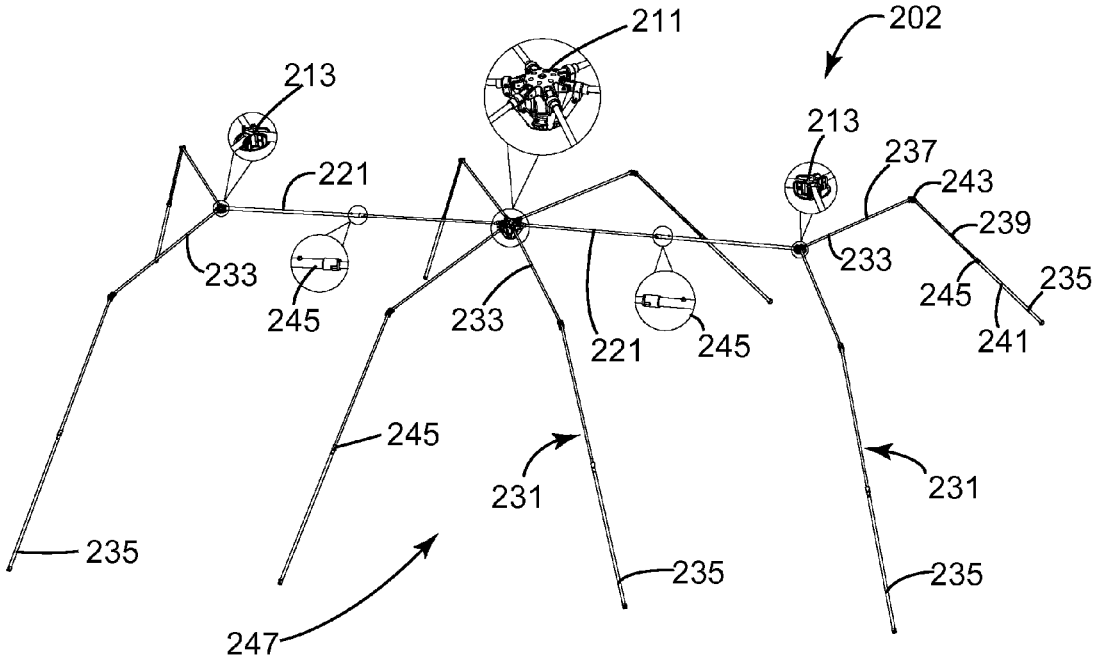
FIG. 9 is a perspective view of an embodiment of a frame assembly of the present invention, shown in FIG. 8 without retractable roof poles, in an open configuration.

Auxiliary hubs 213 are positioned on opposing sides of the central hub 211 such that each of the hubs are aligned along a common vertical plane. The auxiliary hubs 213 of this embodiment are substantially similar to the hub 111 shown in FIGS. 35-37 and described above. Each auxiliary hub 213 is connected to the central hub 211 with a roof pole 221 to form a roof portion of the tent 201. Each roof pole 221 is pivotally connected to each opposing hub 211, 213 at upper engagement point 5A. As it will be described in other embodiments below, the frame assembly 210 could be constructed with more than two roof poles depending on the desired overall configuration of the tent. Also, the roof poles 221 could have multiple collapsible sections to add length to the tent 202 when in the open configuration while maintaining a relatively short pole length when collapsed or retracted in the folded configuration. For example, as shown in FIG. 9, each roof pole 221 includes two sections which are telescopically retractable by conventional spring pin-aperture means as described above. One of ordinary skill in the art will recognize that other means could be utilized, for example, a lockable joint for folding each section or other sliding means, without departing from the spirit and scope of the present invention.

Figure 10:
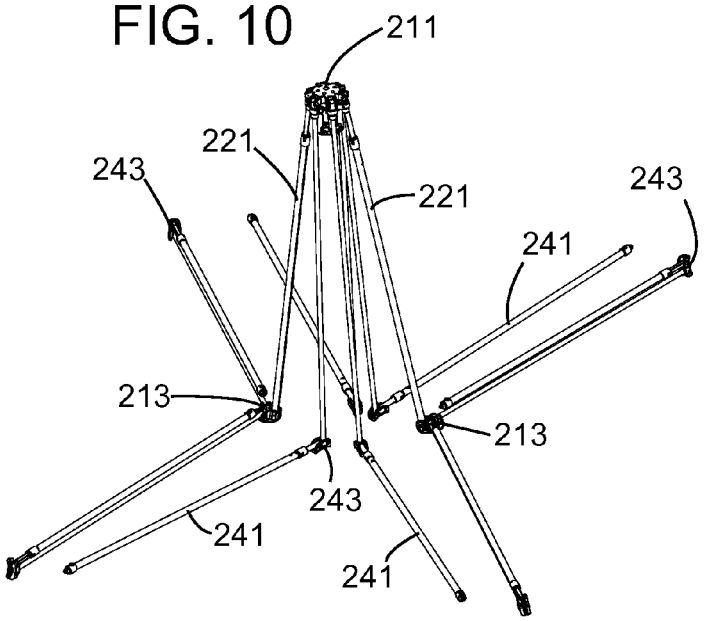
FIG. 10 is a perspective view of the frame assembly of FIG. 9 in a partially folded configuration.
Figure 11:
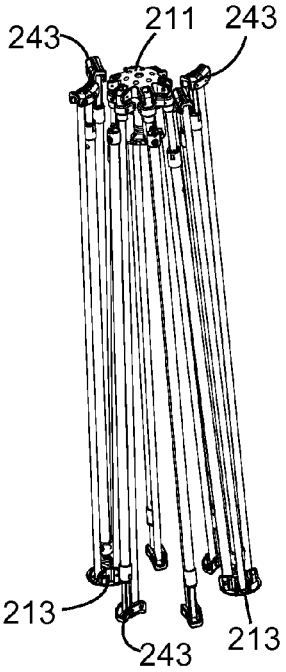
FIG. 11 is a perspective view of the frame assembly of FIG. 9 in a fully folded configuration.

Still referring to FIGS. 8-11, the frame assembly 202 also includes a plurality of leg poles 231. Each leg pole 231 includes an inner end 233 and an outer end 235. In this embodiment, the leg poles 231 support the central portion as well as each side portion of the frame assembly 202. The inner ends 233 are pivotally connected to each hub 211, 213 and the leg poles 231 are extended radially outward and away from the central portion of the frame assembly 202. In this embodiment, four leg poles 231 are pivotally connected with the central hub 211. However, as shown in another embodiment in FIG. 12, two leg poles 231 could be connected to the central hub 211. Moreover, additional leg poles 231 could be attached to each hub 211, 213 depending on the desired overall appearance of the tent without departing from the spirit and scope of the present invention. Each leg pole 231 includes an upper section (or lower roof pole) 237, a middle section 239 and a lower section 241. In this embodiment, the upper and middle sections 237, 239 are pivotally coupled together with a conventional pivoting joint 243 which includes opposing channels (not shown) positioned above a bottom surface (not shown) for receiving each of the adjoining sections 237, 239. The pivoting joint 243 is configured such that when the frame assembly 202 is in the open configuration as shown in FIG. 9, the upper and middle sections 237, 239 are fixed at an angle, and such that the upper and middle sections 237, 239 could be folded against each other when the frame assembly 202 is in the partially folded and fully folded configurations as shown in FIGS. 10 and 11, respectively. In this embodiment, the middle and lower sections 239, 241 are telescopically coupled together by conventional means and lockable in an extended position with a spring biased locking mechanism 245. However, one of ordinary skill in the art will recognize that other methods and means could be used to couple and lock the middle and lower sections 239, 241 including but not limited to a lockable pole joint such that the sections 239, 241 are pivotable toward each other when folding the frame assembly 202. Referring to FIG. 9, in an open configuration, the frame assembly 202 surrounds a radially inner space 247.

Figure 8:
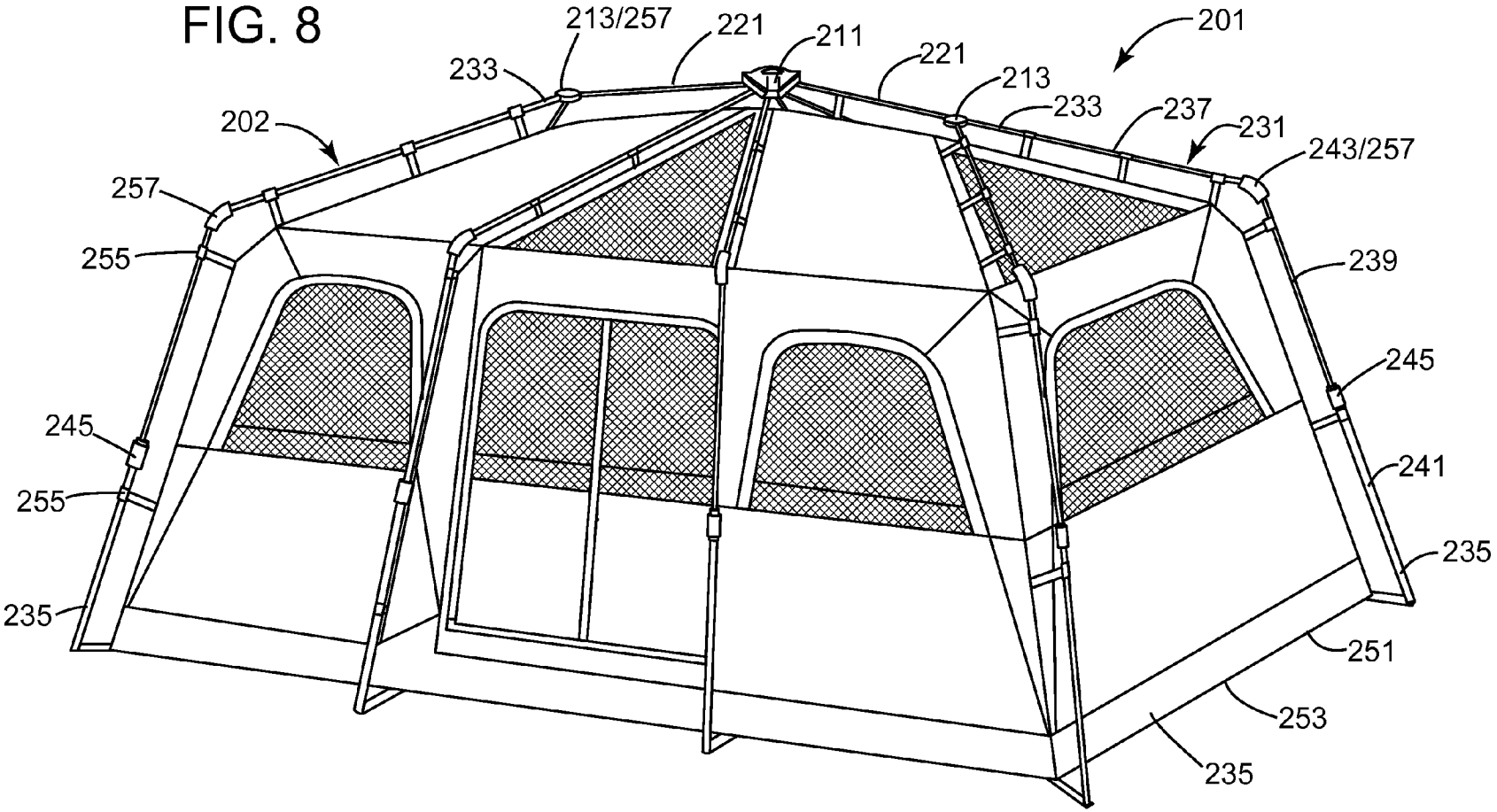
FIG. 8 is perspective view of another embodiment of a foldable tent of the present invention.

Referring to FIG. 8, a foldable tent 201 of the present invention is shown for which the frame assembly 202 (without retractable roof poles) shown in FIGS. 9-11 is utilized. A tent fabric or canopy 251 is disposed within the radially inner space 247 formed by the frame assembly 202. In this embodiment, the tent fabric 251 is an enclosure 253 having a roof, four side walls and a floor stitched together. The foldable tent 201 is shown with features such as doors, windows and vents, however, the tent could be constructed with more or less features than shown. Also, each of the pivoting joints 243 and auxiliary hubs 213 are covered with a fabric casing 257 which protects the tent fabric 251 from damage when the tent is folded. The enclosure 253 is fixedly slidably attached by slidable hooks 255 at various locations to the frame assembly 202. In the open configuration as shown in FIG. 8, the enclosure 253 is substantially taut and forms a substantially flat surface on the roof, side walls and floor. The frame assembly 202 is further stabilized by the tension created by the tent fabric 251. In this embodiment, the rigid frame assembly 202 coupled with the tent fabric 251 forms a cabin style tent. One of ordinary skill in the art will recognize that other tent fabrics could be attached to the frame assembly 202. For example, a tent fabric having a roof, side walls partially constructed of mesh and no floor could be utilized to form a screen house, or a tent fabric having only a roof and additional fabric along the leg poles could be utilized to form an open shelter.

Referring to FIGS. 9-11, even though the tent fabric 251 is attached to the frame assembly 202 at all times and collectively opened and folded, the operation of the foldable tent shown in FIG. 8 is shown without the tent fabric 251 for purposes of clarity. From the open configuration (FIG. 9), the middle and lower sections of the leg poles 239, 241 are retracted to form a first folded section. Each of the first folded sections are pivoted outward and upward about each corresponding pivoting joint 243 toward each corresponding upper section 237 to form a second folded section (FIG. 10). Each of the roof poles 221 are also retracted and pivoted downward with respect to the central hub 211. Each second folded section is then pivoted upward about each auxiliary hub 213 into a fully folded configuration (FIG. 11). In the fully folded configuration, top portions of each auxiliary hub 213 and a bottom portion of the bottom portion of the central hub 211 face each other.

Figure 12:
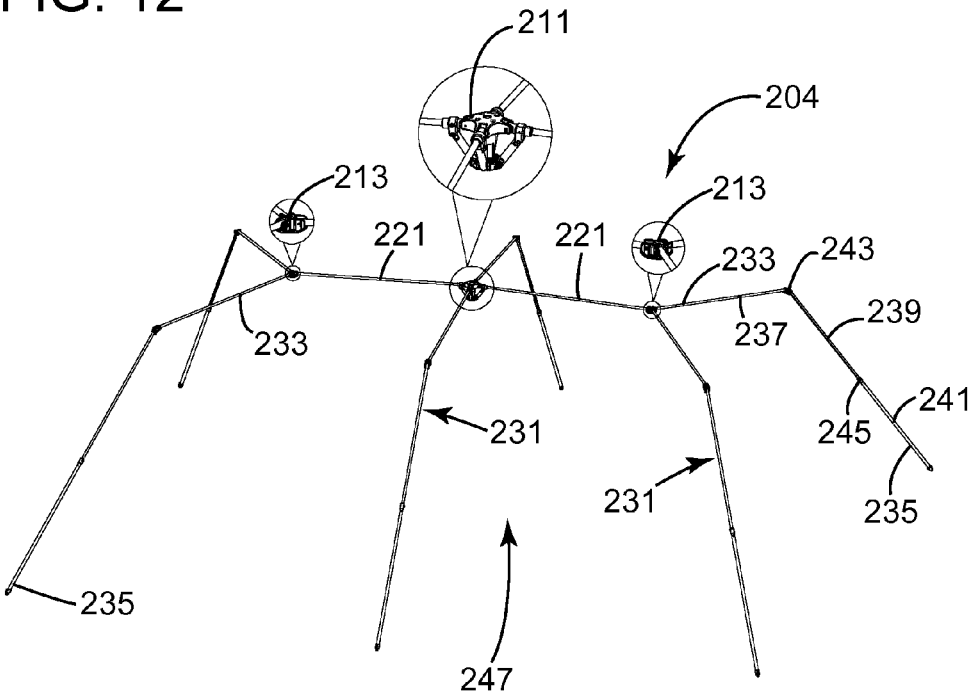
FIG. 12 is a perspective view of another embodiment of a frame assembly of the present invention in an open configuration.
Figure 13:
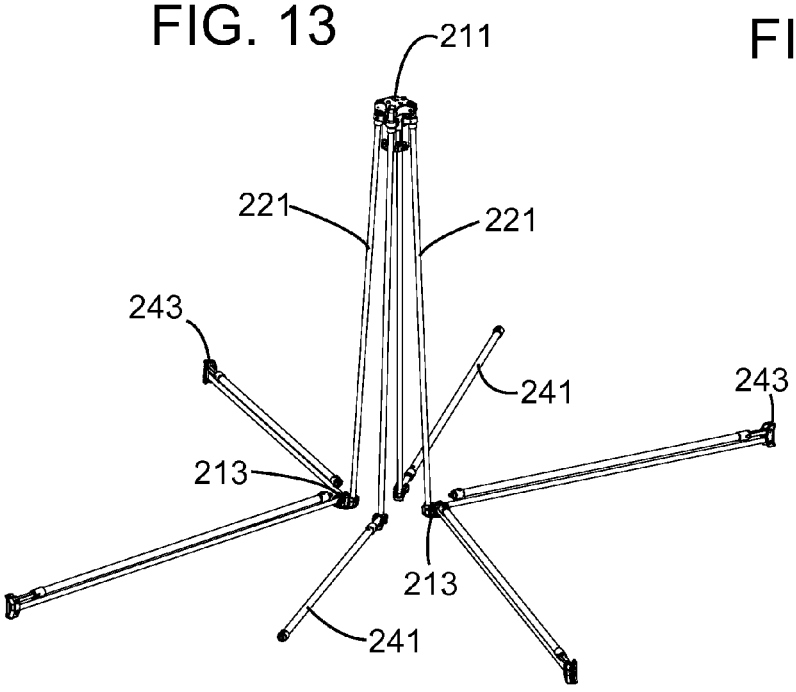
FIG. 13 is a perspective view of the frame assembly of FIG. 12 in a partially folded configuration.
Figure 14:
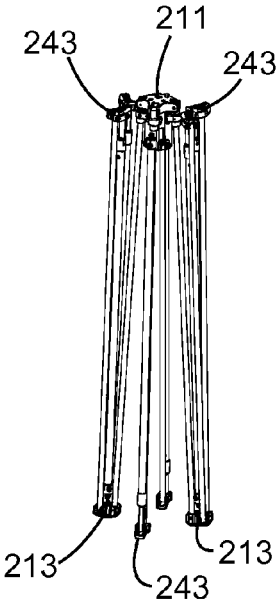
FIG. 14 is a perspective view of the frame assembly of FIG. 12 in a fully folded configuration.

Referring to FIGS. 12-14, another embodiment of a frame assembly 204 of the present invention is shown. The structural components of this embodiment are substantially identical to the frame assembly 202 described above for which identical components are referenced with identical numbers, and the folding method is identical to the frame assembly 202 described above. In this embodiment, only two leg poles 231 extend from the central hub 211 and the roof poles 221 are not retractable. This type of frame assembly is more compact with fewer components and could be used for smaller instant tents, shelters and screen houses.

Figure 18:
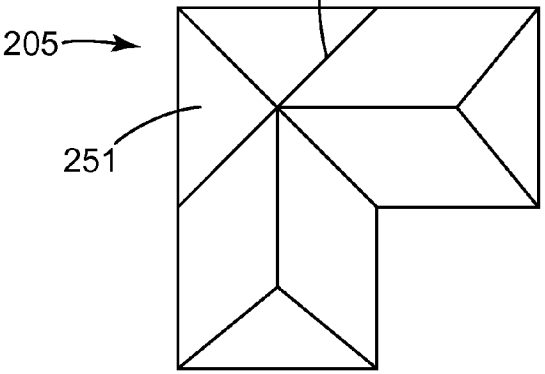
FIG. 18 is a schematic plan view of an embodiment of a foldable tent of the present invention with the frame assembly of FIG. 15.
Figure 17:
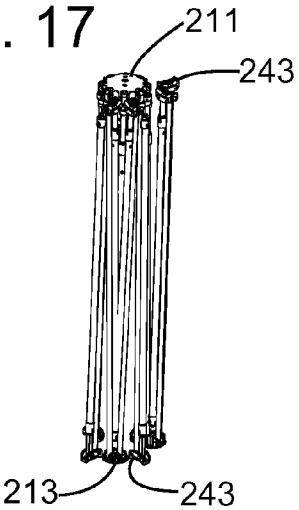
FIG. 17 is a perspective view of the frame assembly of FIG. 15 in a fully folded configuration.
Figure 15:
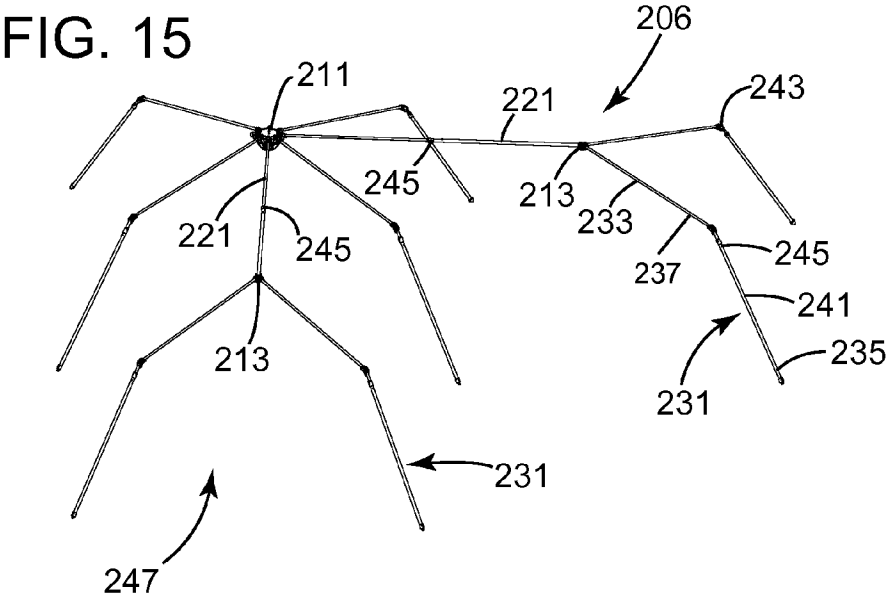
FIG. 15 is a perspective view of another embodiment of a frame assembly of the present invention in an open configuration with a lower portion of the leg poles retracted.
Figure 16:
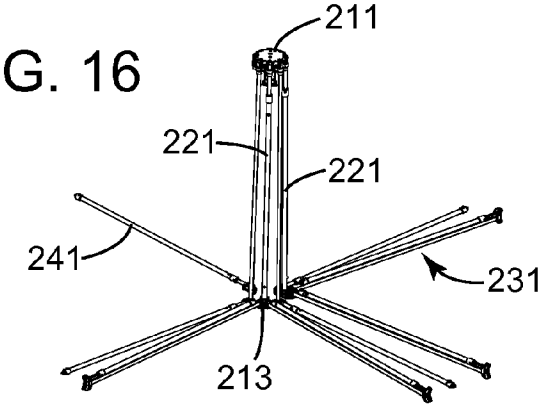
FIG. 16 is a perspective view of the frame assembly of FIG. 15 in a partially folded configuration.

Referring to FIGS. 15-18, another embodiment of a frame assembly 206 of the present invention is shown. The structural components of this embodiment are substantially identical to the frame assembly 202 described above for which identical components are referenced with identical numbers, and the folding method is identical to the frame assembly 202 described above. In this embodiment, four leg poles 231 extend from the central hub 211, while two retractable roof poles 221 extend from the central hub 211 substantially at a right angle. Referring to FIG. 18, when the tent fabric 251 is attached to the frame assembly 206 (by the same means and method described above with respect to the tent 201), a substantially L-shaped cabin tent 205 is formed. This overall configuration allows for a larger tent which could be provided with interior dividers (not shown) to form separate rooms and/or vestibules (not shown) and multiple entrances.

Figure 22:
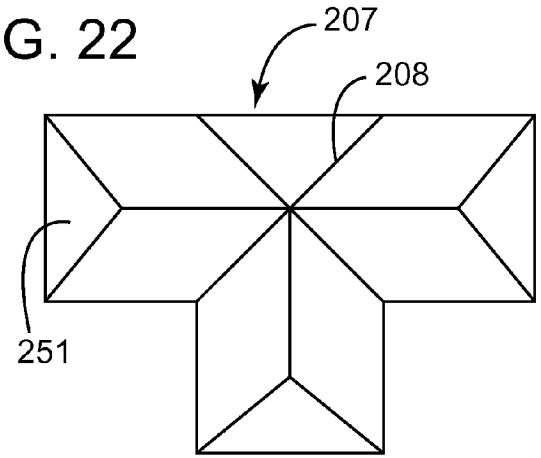
FIG. 22 is a schematic plan view of an embodiment of a foldable tent of the present invention with the frame assembly of FIG. 19.
Figure 21:
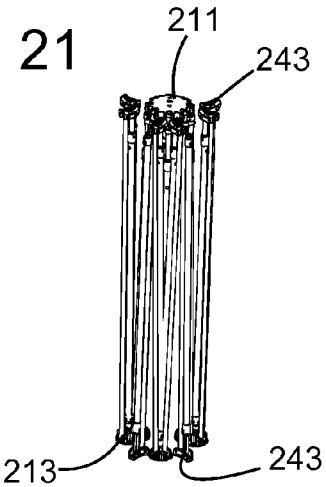
FIG. 21 is a perspective view of the frame assembly of FIG. 19 in a fully folded configuration.
Figure 19:
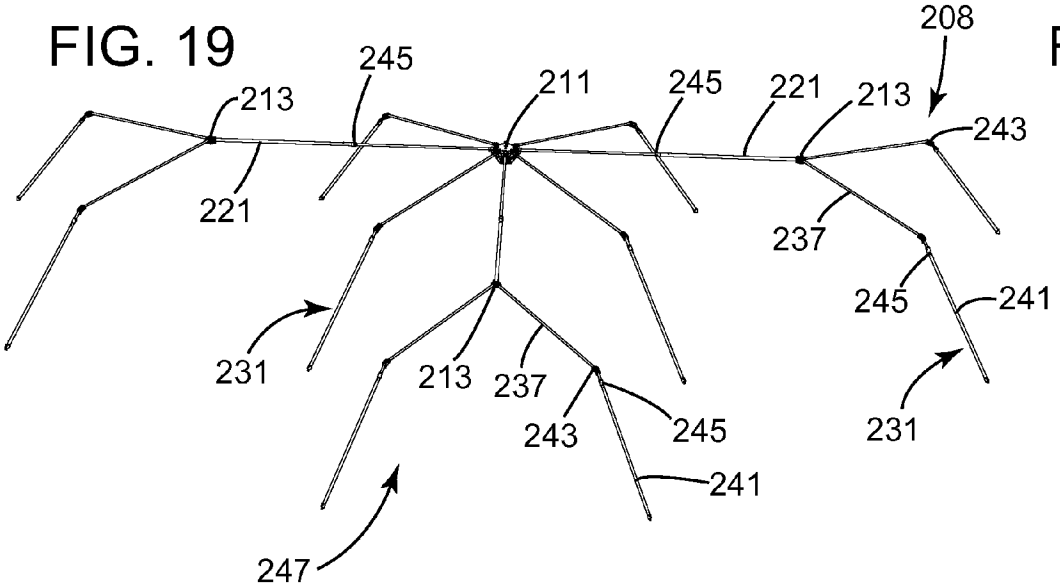
FIG. 19 is a perspective view of another embodiment of a frame assembly of the present invention in an open configuration with a lower portion of the leg poles retracted.
Figure 20:
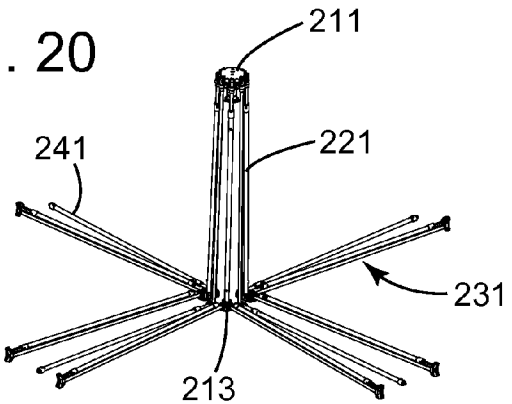
FIG. 20 is a perspective view of the frame assembly of FIG. 19 in a partially folded configuration.

Referring to FIGS. 19-22, another embodiment of a frame assembly 208 of the present invention is shown. The structural components of this embodiment are substantially identical to the frame assembly 202 described above for which identical components are referenced with identical numbers, and the folding method is identical to the frame assembly 202 described above. In this embodiment, four leg poles 231 extend from the central hub 211, while three retractable roof poles 221 extend from the central hub 211. Two of the roof poles 221 are substantially aligned with each other while the remaining roof pole 221 extends substantially perpendicular to the other two roof poles 221. Referring to FIG. 22, when the tent fabric 251 is attached to the frame assembly 208 (by the same means and method described above with respect to the tent 201), a substantially T-shaped cabin tent 207 is formed. This overall configuration allows for a larger tent which could be provided with interior dividers (not shown) to form separate rooms and/or vestibules (not shown) and multiple entrances.

Figure 26:
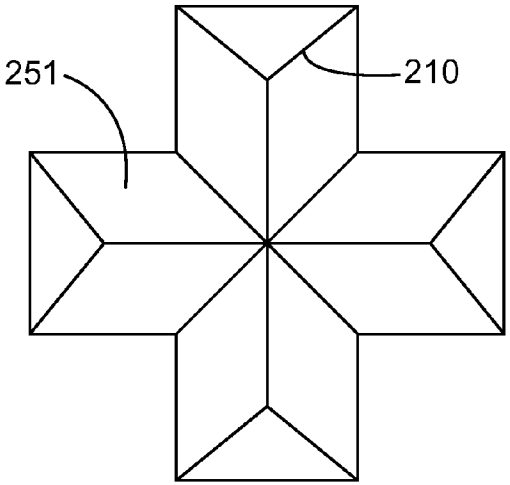
FIG. 26 is a schematic plan view of another embodiment of a foldable tent of the present invention with the frame assembly of FIG. 23.
Figure 25:
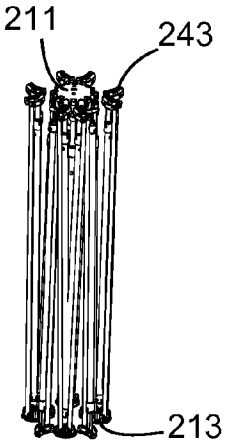
FIG. 25 is a perspective view of the frame assembly of FIG. 23 in a fully folded configuration.
Figure 23:
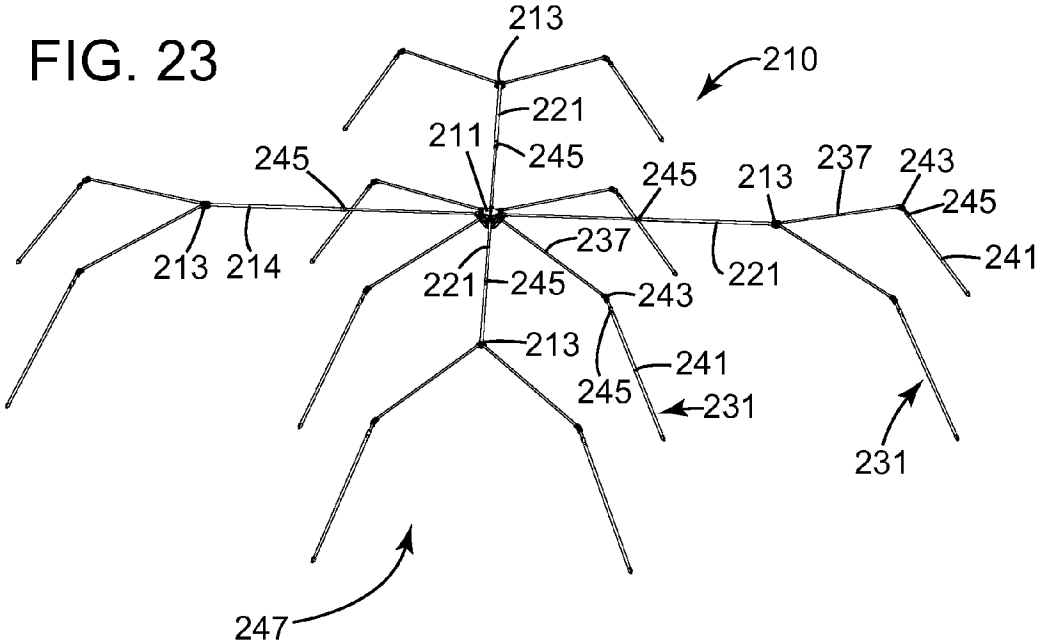
FIG. 23 is a perspective view of another embodiment of a frame assembly of the present invention in an open configuration with a lower portion of the leg poles retracted.
Figure 24:
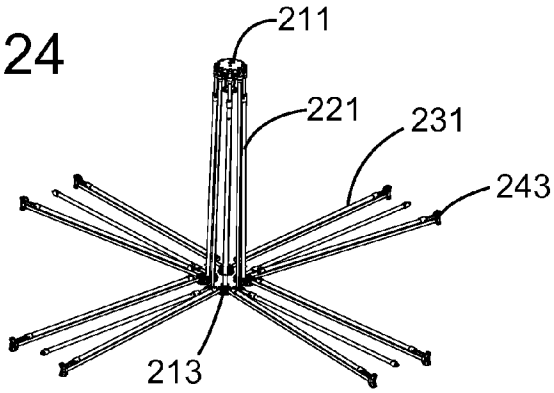
FIG. 24 is a perspective view of the frame assembly of FIG. 23 in a partially folded configuration.

Referring to FIGS. 23-26, another embodiment of a frame assembly 210 of the present invention is shown. The structural components of this embodiment are substantially identical to the frame assembly 202 described above for which identical components are referenced with identical numbers, and the folding method is identical to the frame assembly 202 described above. In this embodiment, four leg poles 231 extend from the central hub 211, while four retractable roof poles 221 extend from the central hub 211. Two of the roof poles 221 are substantially aligned with each other while the other two roof poles 221 are substantially aligned with each other and extend substantially perpendicular to the other two roof poles 221. Referring to FIG. 26, when the tent fabric 251 is attached to the frame assembly 210 (by the same means and method described above with respect to the tent 201), a substantially X-shaped cabin tent 209 is formed. This overall configuration allows for a larger tent which could be provided with interior dividers (not shown) to form separate rooms and/or vestibules (not shown) and multiple entrances.

In the present embodiments 201-210, each pole 221, 237, 239 and 241 is constructed of a rigid tubular steel having a diameter between 14.5 mm and 16 mm. One of ordinary skill in the art will recognize that other materials such as other metals (e.g., aluminum), metal alloys, other polymers and composite materials or any combination thereof could be used, and different sizes of poles could be used depending on desired strength without departing from the spirit and scope of the invention.

The various embodiments shown in FIGS. 8-25 provide a larger foldable tent which the market today lacks. Specifically, foldable or instant tents necessary for accommodating more than nine people are non-existent because foldable tent frame assemblies of the prior art cannot support such volume. Instead, foldable tents with such large volume often times fail or collapse during moderate to heavy winds. Therefore, larger tents in the prior art must be manually assembled and disassembled. The frame assemblies shown in the FIGS. 8-25, however, are easy to set up and fold, and provide the much needed larger instant tent with increased head space. Furthermore, the various embodiments of the frame assemblies 202, 204, 206, 208, 210 could be used with a variety of tent fabrics pre-assembled to the frame assembly to form, for example, an enclosed instant tent, an open instant shelter or an instant screen house.

Referring to FIGS. 27-34, other embodiments of a foldable tent of the present invention are shown. Specifically, FIGS. 27-30 show an embodiment having a hexagonal structure 301 and FIGS. 31-34 show an embodiment having an octagonal structure 303.

Figure 27:
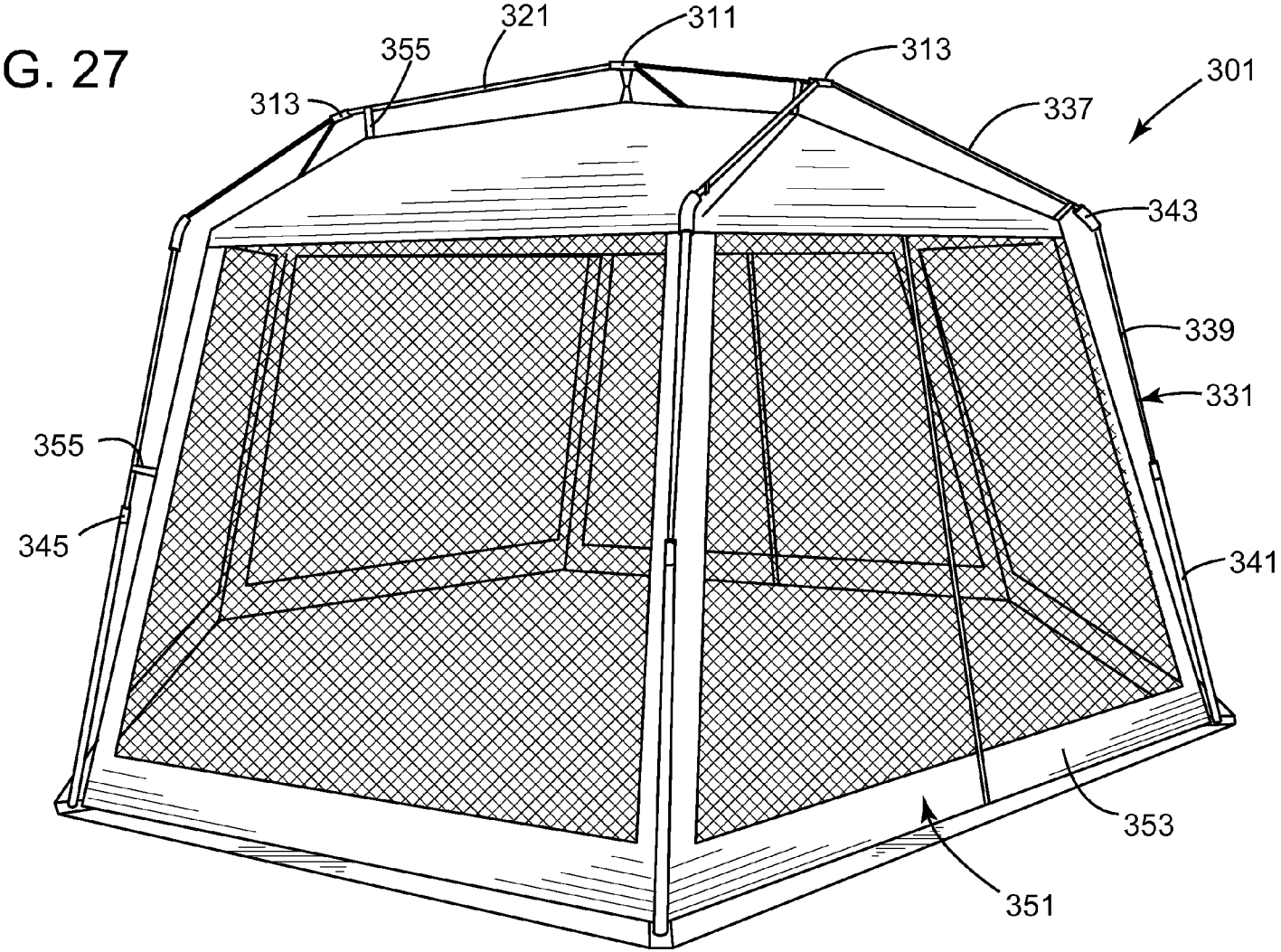
FIG. 27 is a perspective view of another embodiment of a foldable tent of the present invention.
Figure 28:
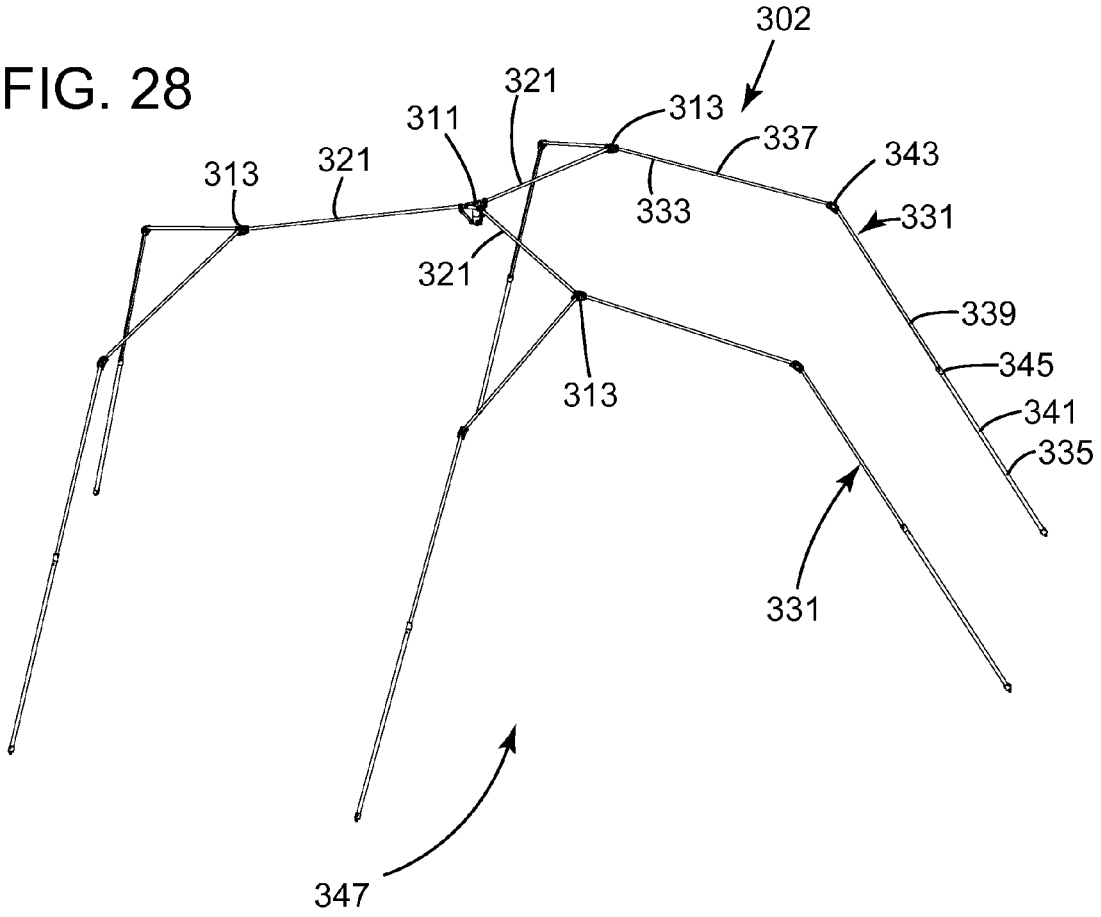
FIG. 28 is a perspective view of another embodiment of a frame assembly of the present invention, shown in FIG. 27, in an open configuration.
Figure 29:
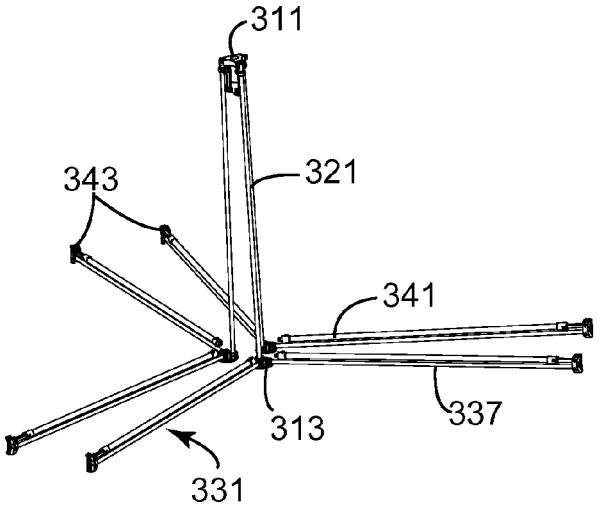
FIG. 29 is a perspective view of the frame assembly of FIG. 28 in a partially folded configuration.
Figure 30:
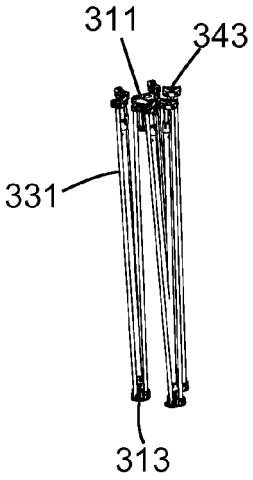
FIG. 30 is a perspective view of the frame assembly of FIG. 28 in a fully folded configuration.

Referring to FIGS. 27-30, the foldable tent 301 includes a central hub 311 having three radially spaced apart roof poles 321, inner ends of which are pivotally connected to the central hub 311 for pivotal movement from a substantially horizontal position in an open configuration to a downward vertical position in a folded configuration. In this embodiment, the central hub 311 is identical to the central hub 211 described with respect to the frame assembly 202 above. In an open configuration, as shown in FIGS. 27 and 28, the roof poles 321 extend radially outward from the central hub 311 and are pivotally connected to corresponding auxiliary hubs 313 at outer ends. The auxiliary hubs 313 of this embodiment are substantially similar to the hub 111 shown in FIGS. 35-37 and described above, and are configured for pivotally connecting with poles such that the poles are pivotable upwardly from the open configuration to a closed configuration as shown in FIGS. 29 and 30. The roof poles 321 could have multiple collapsible or retractable sections if desired.

Still referring to FIGS. 27-30, the frame assembly 302 also includes a plurality of leg poles 331. Each leg pole 331 includes an inner end 333 and an outer end 335. In this embodiment, the leg poles 331 support the roof portion as well as radially outer portions of the frame assembly 302. The inner ends 333 are pivotally connected to each auxiliary hub 313 and the leg poles 331 are extended radially outward and away from the central portion of the frame assembly 302. In this embodiment, two leg poles 331 are pivotally connected with each auxiliary hub 313. However, additional leg poles could be attached to each auxiliary hub 313 depending on the desired overall appearance of the tent. Each leg pole 331 includes an upper section (or lower roof pole) 337, a middle section 339 and a lower section 341. In this embodiment, the upper and middle sections 337, 339 are pivotally coupled together with a conventional pivoting joint 343 which includes opposing channels (not shown) positioned above a bottom surface (not shown) for receiving each of the adjoining sections 337, 339. The pivoting joint 343 is configured such that when the frame assembly 302 is in the open configuration as shown in FIGS. 27 and 28, the upper and middle sections 337, 339 are fixed at an angle, and such that the upper and middle sections 337, 339 could be folded against each other when the frame assembly 302 is in the partially folded and fully folded configurations as shown in FIGS. 29 and 30, respectively. In this embodiment, the middle and lower sections 339, 341 are telescopically coupled together by conventional means and lockable in an extended position with a spring biased locking mechanism 345. However, one of ordinary skill in the art will recognize that other methods and means could be used to couple and lock the middle and lower sections 339, 341 including but not limited to a lockable pole joint such that the sections 339, 341 are pivotable toward each other when folding the frame assembly. Referring to FIG. 28, when the frame assembly 302 is in an open configuration, the frame assembly 302 surrounds a radially inner space 347.

Referring to FIG. 27, a tent fabric or canopy 351 is disposed within the radially inner space 347 formed by the frame assembly 302. In this embodiment, the tent fabric 351 is a partial enclosure 353 having an impermeable roof and six permeable side walls (preferably mesh) stitched together while having an open floor to form a screen house. Screen houses are particularly useful when one desires ample ventilation and/or shade while preventing bugs or mosquitoes from entering living quarters or entertaining space. The foldable tent or screen house 301 is shown with features such as doors having slide fasteners (zippers) and ground flaps, however, the tent could be constructed with more or less features than shown. Also, each of the pivoting joints 343 and auxiliary hubs 313 are covered with a fabric casing 357 which protects the tent fabric 351 from damage when the tent is folded, but could be constructed without the fabric casings 357. The enclosure 353 is permanently slidably attached by hooks 355 at various locations to the frame assembly 302. In the open configuration as shown in FIG. 27, the partial enclosure 353 is substantially taut and forms a substantially flat surface on the roof and side walls. The frame assembly 302 is further stabilized by the tension created by the tent fabric 351. In this embodiment, the rigid frame assembly 302 coupled with the tent fabric 351 forms a hexagonal screen house. One of ordinary skill in the art will recognize that other tent fabrics could be attached to the frame assembly 302. For example, a fully enclosed tent fabric having a roof, side walls and floor stitched together could be utilized to form an enclosed tent or a tent fabric having only a roof and optional fabric along the leg poles could be utilized to form an open shelter.

Referring to FIGS. 31-34, another embodiment of a foldable tent 303 with another embodiment of a frame assembly 304 of the present invention is shown. The structural components of this embodiment are substantially identical to the frame assembly 302 and tent fabric 351 described above with respect to the foldable tent 301, for which identical components are referenced with identical numbers. In this embodiment, four roof poles 321 pivotally extend from the central hub 311 on one end and each roof pole 321 is pivotally connected with a corresponding auxiliary hub 313 on an opposing end. Two leg poles 331 are pivotally connected to and extend radially outward from each auxiliary hub 313 to form an octagonal screen house. In each of the embodiments 301, 303, the poles 321, 331 are constructed of hollow steel having a diameter between 14.5 mm and 16 mm to provide sufficient strength to support the overall structure through windy conditions. However, other materials of different sizes could be used such as aluminum, metal alloys, fiberglass reinforced plastic, composite materials or any combination thereof.

Figure 31:
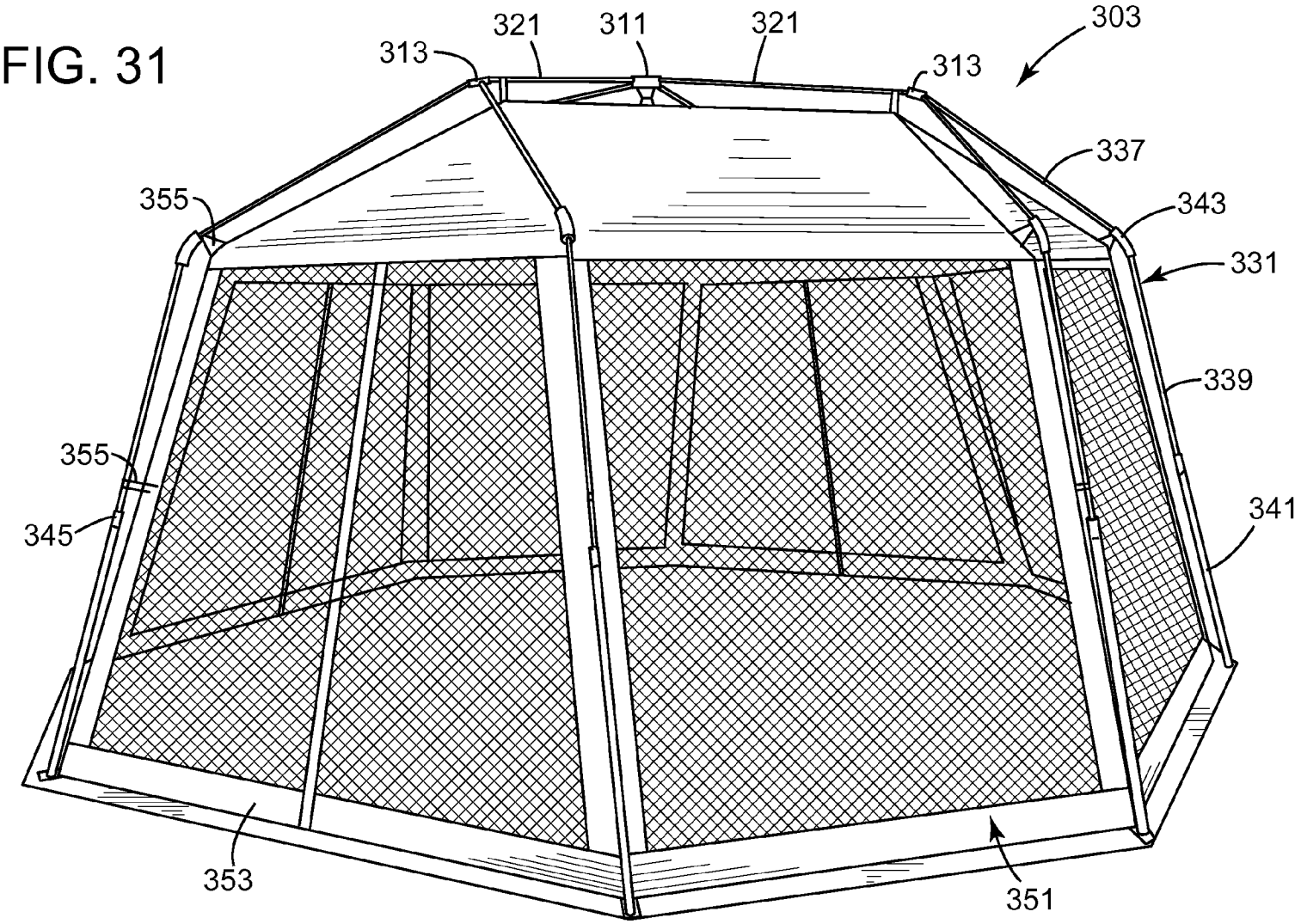
FIG. 31 is a perspective view of another embodiment of a foldable tent of the present invention.
Figure 32:
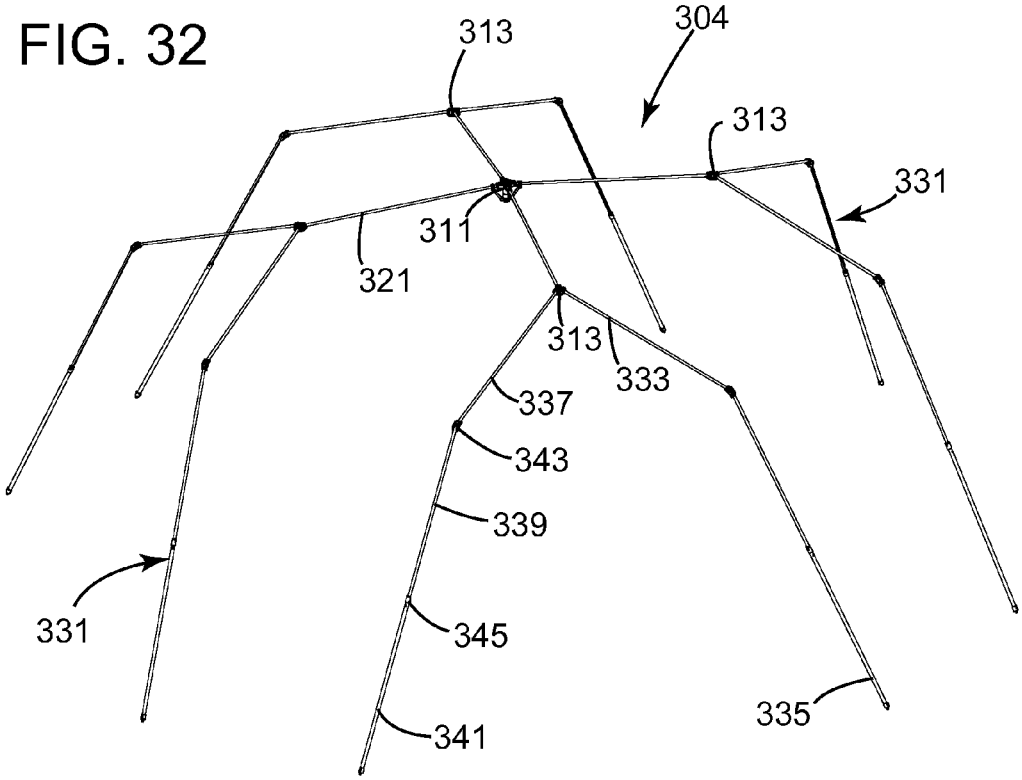
FIG. 32 is a perspective view of another embodiment of a frame assembly of the present invention, shown in FIG. 31, in an open configuration.
Figure 33:
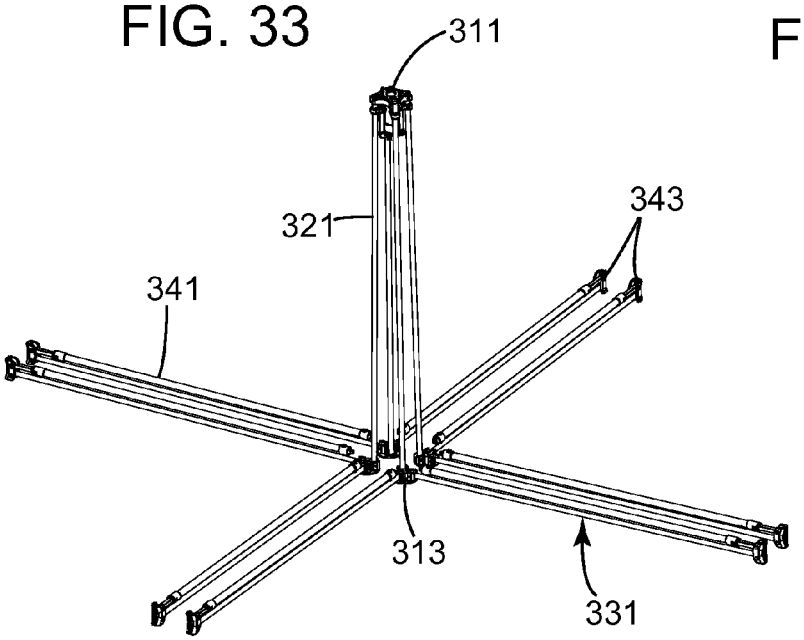
FIG. 33 is a perspective view of the frame assembly of FIG. 32 in a partially folded configuration.
Figure 34:
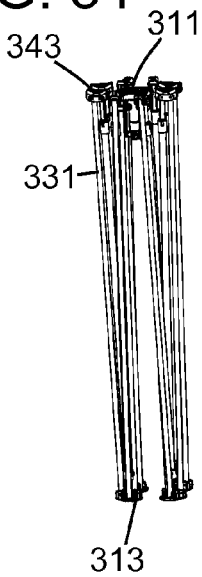
FIG. 34 is a perspective view of the frame assembly of FIG. 32 in a fully folded configuration.

Referring to FIGS. 28-30 and 32-34, even though the tent fabric 351 is attached to the frame assembly 302, 304, respectively, at all times, the operation of the foldable tent shown in FIGS. 27 and 31 is shown without the tent fabric 351 for purposes of clarity. From the open configuration (FIGS. 28 and 32), the middle and lower sections of the leg poles 339, 341 are retracted to form a first folded section. Each of the first folded sections are pivoted outward and upward about each corresponding pivoting joint 343 toward each corresponding upper section 337 to form a second folded section (FIGS. 29 and 33). Each of the roof poles 321 are also retracted and pivoted downward with respect to the central hub 311. Each second folded section is then pivoted upward about each auxiliary hub 311 into a fully folded configuration (FIGS. 30 and 34). In the fully folded configuration, top portions of each auxiliary hub 311 face the central hub 311.

The embodiments shown in FIGS. 27-34 and described in detail above provide a large but stable tent structure to accommodate a large number of people. Head room is ample and a comfortable and safe outdoor environment is provided while ease in set up and folding is achieved.

In instant tents of the prior art, the roof portion of the tent is supported with a single central hub and several continuous poles which extend to the upper corners of the tent. In the present embodiments 101-103, 201-210 and 301-304, the angles (with respect to a horizontal plane) at which the central roof pole 121, 221, 321 and lower roof poles 137, 237, 337 extend are much less than the angle at which a continuous pole of comparable instant tents of the prior art extends, and thus, more volume and head room are provided.

Also, the stresses in tent structures are mostly concentrated on the upper or roof portion of the frame assembly where the poles are closer to a horizontal position. For foldable frames of the prior art which utilize only a single central hub and have continuous upper poles extending from the central hub to the upper corners of the tent, those stresses are concentrated on the central hub and upper poles. This requires the use of a substantially large hub and upper poles with larger diameters to accommodate for those stresses. Even so, damage to or failure of the central hub is possible. For the tents of the present invention 101-103, 201-210, 301-304, the upper structure of the tent, i.e., hubs 111, 211, 213, 311, 313; roof pole 121, 221, 321; and lower roof pole 137, 237, 337; serves as a means for more evenly distributing the stresses generated from the tent fabric 151, 251, 351 and other elements such as wind. Because the stresses are more evenly distributed among smaller pole sections and multiple hubs, smaller hubs are utilized and poles with a small diameter can be used, thereby reducing the overall weight of the tent and also cutting material cost.

Moreover, in these embodiments 101-103, 201-210, 301-304, the tent is capable of being folded into a more compact state than a comparable instant tent of the prior art. Especially, for the tent embodiments 201-210, 301, 303, the tent is capable of being folded into a compact state despite the large volume of the tent in the open configuration which can accommodate a large number of people. This is because the overall folded length of the tent is dictated by the length of the roof pole 121, 221, 321 which covers a partial length of the roof. In contrast, roof poles used for instant tents with single central hubs covers the entire diagonal length of the roof spanning from the center to corner. Almost invariably, the length of the roof pole 121, 221, 321 whether retracted or not, is less than the length of roof poles of comparable tents in the prior art. Thus, the compact folded instant tents of the present invention 101-103, 201-210, 301-304 are advantageous for storage and transport.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A foldable tent comprising a frame assembly coupled to a tent fabric, the frame assembly and tent fabric collectively collapsible from an open configuration to a folded configuration, the frame assembly comprising:

a first hub spaced apart from a second hub, each hub having an upwardly facing top portion when in the open configuration;

a central roof pole having opposing ends, the central roof pole positioned at a central portion of the frame assembly, each respective end of the roof pole pivotally coupled with the first and second hubs; and a plurality of leg poles each having an inner end and an outer end, each leg pole being collapsible in between the inner and outer ends, the inner ends of each leg pole pivotally coupled to a corresponding hub, wherein in the open configuration each leg pole extends radially outward with respect to the central roof pole and the outer ends of each leg pole engages a ground surface;

wherein the tent fabric is fixable and slidably coupled to the frame assembly such that the tent fabric is positioned within a radially inner space surrounded by the frame assembly when the tent is in the open configuration; and wherein in the folded configuration the central roof pole and leg poles are pivoted upward with respect to each hub to a position substantially perpendicular to each hub such that top portions of each hub face each other and the central roof pole and leg poles are positioned substantially between the hubs.

2. The foldable tent of claim 1, wherein each leg pole comprises an upper section, a middle section and a lower section, the upper and middle sections pivotally coupled together, the upper and middle sections positioned at an angle when the tent is in the open configuration and foldable toward each other when the tent is in the folded configuration, the middle and lower sections substantially aligned with each other and slidably coupled together such that said sections are telescopically retractable.

3. The foldable tent of claim 1, wherein at least two leg poles are coupled to each hub.

4. The foldable tent of claim 1, wherein the central roof pole is collapsible.

5. The foldable tent of claim 1, wherein the central roof pole is rigid and substantially horizontal when the tent is in the open configuration.

6. . The foldable tent of claim 1, wherein the central roof pole is substantially flexible and forms a curvature when the tent is in the open configuration.

7. A foldable tent comprising a frame coupled to a canopy, the frame and canopy collectively collapsible from an open configuration to a folded configuration, the frame comprising:

a central hub positioned at an apex of the tent when in the open configuration, a plurality of roof poles having an inner end and an outer end, each roof pole inner end pivotally coupled to the central hub and extending radially outward therefrom, a plurality of auxiliary hubs, each roof pole outer end pivotally coupled to a corresponding auxiliary hub, and a plurality of collapsible leg poles each having an inner end section and an outer end section, the inner end section of each leg pole pivotally coupled to a respective auxiliary hub, the outer end section of each leg pole having an upper end pivotally coupled to a respective inner end section, the outer end section of each leg pole having a lower free end engaging a ground surface when the tent is in the open configuration;

wherein the central hub positioned at the apex is displaced vertically relative to each of the roof poles, auxiliary hubs, and leg poles in the open configuration;

wherein the canopy is permanently slidably coupled to the frame such that the canopy is positioned within a radially inner space surrounded by the frame when the tent is in the open configuration;

wherein at least three poles are coupled to each auxiliary hub;

wherein in the folded configuration each of the poles connected to the central hub are pivoted downward with respect to the central hub and each of the poles connected to a respective auxiliary hub are pivoted upward with respect to each auxiliary hub such that each auxiliary hub is adjacent to each other and the poles are disposed substantially between the auxiliary hubs and the central hub.

8. The foldable tent of claim 7, wherein each of the plurality of roof poles are positioned substantially horizontal when the tent is in the open configuration.

9. The foldable tent of claim 7, wherein at least one of the plurality of roof poles includes a plurality of collapsible sections.

10. The foldable tent of claim 7, wherein the plurality of roof poles are substantially equal in length and radially spaced apart substantially equally such that the tent is substantially dome shaped.

11. The foldable tent of claim 7, wherein the plurality of auxiliary hubs includes a first auxiliary hub and a second auxiliary hub, the central hub being positioned in between the first and second auxiliary hubs such that each of said hubs are within a common plane, each of the first and second auxiliary hubs including at least two leg poles extending therefrom such that the tent is substantially rectangular.

12. The foldable tent of claim 7, wherein the plurality of auxiliary hubs includes a first auxiliary hub and a second auxiliary hub, the roof poles corresponding to each auxiliary hub positioned substantially perpendicular to each other, each of the first and second auxiliary hubs including at least two leg poles extending therefrom such that the tent is substantially L-shaped.

13. The foldable tent of claim 12, further comprising a third auxiliary hub, the central hub being positioned in between the first and third auxiliary hubs such that each of said first and third auxiliary hubs are within a common plane, the roof poles corresponding to the first and third auxiliary hubs being substantially perpendicular to the roof pole corresponding to the second auxiliary hub such that the tent is substantially T-shaped.

14. The foldable tent of claim 13, further comprising a fourth auxiliary hub, the central hub being positioned in between the second and fourth auxiliary hubs such that each of said second and fourth auxiliary hubs are within a common plane, the roof poles corresponding to the second and fourth auxiliary hubs being substantially perpendicular to the roof poles corresponding to the first and third auxiliary hubs such that the tent is substantially X-shaped.

15. A foldable tent comprising a frame coupled to a canopy, the frame and canopy collectively collapsible from an open configuration to a folded configuration, the frame comprising:

a plurality of hubs including a first hub and at least a second hub, each hub spaced apart and positioned at an upper portion of the frame, wherein the first hub is positioned at an apex of the tent in the open configuration, at least one upper roof pole having opposing ends, the opposing ends of each of the at least one upper roof poles being pivotally coupled with two adjacent hubs, the opposing ends of the at least one upper roof pole being substantially aligned when in the folded configuration, a plurality of lower roof poles having first and second ends, the first ends of each lower roof pole pivotally coupled to a corresponding hub, each lower roof pole extending radially outward from each respective hub and away from the upper roof pole, the lower roof poles folded upwardly from each respective hub to the folded configuration, and a plurality of side poles having first and second ends, the first ends of each side pole pivotally coupled to a corresponding lower roof pole second end forming an angle between said poles when in the open configuration, each of the second ends of each side pole includes a free end engagable with a ground surface, each side pole being collapsible at a portion between the first and second ends of the side pole;

wherein the first hub positioned at the apex is displaced vertically relative to each of the roof poles, side poles, and at least second hub in the open configuration;

wherein the canopy is slidably coupled to the frame such that the canopy is positioned within a radially inner space surrounded by the frame when the tent is in the open configuration; and wherein in the folded configuration each of poles are folded with respect to each respective hub and positioned substantially between the hubs.

16. The foldable tent of claim 15, wherein the at least one upper roof pole includes a plurality of collapsible sections.

17. The foldable tent of claim 16, wherein at least one of the plurality of side poles is telescopically retractable.

18. The foldable tent of claim 15, wherein at least two side poles are coupled to each hub.

19. The foldable tent of claim 15, wherein the tent in the folded configuration includes:

each of the side poles collapsed to form a plurality of first folded sections;

each first folded section folded against a corresponding lower roof pole to form a plurality of second folded sections;

each second folded section folded against a corresponding upper roof pole to form a plurality of third folded sections; and each third folded section folded against each other.

* * * * *